US010584887B2

(12) United States Patent
Trevelyan

(10) Patent No.: US 10,584,887 B2
(45) Date of Patent: Mar. 10, 2020

(54) LOCALISED PERSONAL AIR CONDITIONING SYSTEM

(71) Applicant: Close Comfort Pty Ltd, Subiaco, Western Australia (AU)

(72) Inventor: James Trevelyan, Subiaco (AU)

(73) Assignee: CLOSE COMFORT PTY LTD, Subiaco, Western Australia (AU)

( * ) Notice: Subject to any disclaimer, the term of this patent is extended or adjusted under 35 U.S.C. 154(b) by 103 days.

(21) Appl. No.: 15/512,459

(22) PCT Filed: Sep. 1, 2015

(86) PCT No.: PCT/AU2015/050514
§ 371 (c)(1),
(2) Date: Mar. 17, 2017

(87) PCT Pub. No.: WO2016/041000
PCT Pub. Date: Mar. 24, 2016

(65) Prior Publication Data

US 2017/0299207 A1 Oct. 19, 2017

(30) Foreign Application Priority Data

Sep. 19, 2014 (AU) ..... 2014903758
Apr. 13, 2015 (AU) ..... 2015901307

(51) Int. Cl.
*F24F 5/00* (2006.01)
*A47C 21/04* (2006.01)
(Continued)

(52) U.S. Cl.
CPC ..... *F24F 5/0096* (2013.01); *A47C 21/044* (2013.01); *A47C 29/006* (2013.01);
(Continued)

(58) Field of Classification Search
CPC ..... A47C 21/044; F24F 5/0096; F24F 1/02; F24F 1/028
See application file for complete search history.

(56) References Cited

U.S. PATENT DOCUMENTS 2,071,026 A * 2/1937 Crosley Powel, Jr. ..... F24F 1/025 165/115
2,159,741 A 5/1939 Kettering et al.
(Continued)

FOREIGN PATENT DOCUMENTS

CN 2259099 8/1997
CN 1051140 10/1997
(Continued)

OTHER PUBLICATIONS

International Search Report dated Nov. 13, 2015 for Appln. No. PCT/AU2015/050514.

*Primary Examiner* — Christopher R Zerphey
(74) *Attorney, Agent, or Firm* — Pillsbury Winthrop Shaw Pittman, LLP

(57) ABSTRACT

An air conditioner system including a sleeping enclosure defining a sleeping space into which conditioned air is adapted to be delivered from one end or side of the sleeping space in a manner which maximizes contact between conditioned air and a person or persons in the sleeping space, the sleeping space including an upper air pervious section; and a lower relatively air impervious section adapted to surround a bed in the sleeping space and configured to minimize passage of the conditioned air from the sleeping space through the pervious section or other leakage paths; and an air conditioner unit for generating a conditioned air flow, wherein the impervious section extends to a height above the sleeping surface of the bed at the end or side of the bed opposed to said end or side sufficient to contain the condi-
(Continued)

tioned air as it moves towards and returns from the opposite end or side of the sleeping space, and wherein the impervious section extends to a sufficiently increased height above the sleeping surface at the opposite end or side to allow the direction of air flow to reverse towards said one end or side without substantial loss of conditioned air through the pervious section.

46 Claims, 16 Drawing Sheets

(51) Int. Cl.

| | |
|---|---|
| ***A47C 29/00*** | (2006.01) |
| ***F24F 13/08*** | (2006.01) |
| ***F24F 13/06*** | (2006.01) |
| ***F24F 1/02*** | (2019.01) |
| ***F24F 1/022*** | (2019.01) |

(52) U.S. Cl.
CPC ..... *F24F 1/02* (2013.01); *F24F 1/022* (2013.01); *F24F 5/001* (2013.01); *F24F 13/0604* (2013.01); *F24F 13/081* (2013.01); *F24F 2013/088* (2013.01)

(56) References Cited

U.S. PATENT DOCUMENTS

| | | | | |
|---|---|---|---|---|
| 2,567,915 | A | 9/1951 | Smith | |
| 3,896,634 | A | 7/1975 | Nagele et al. | |
| 6,425,255 | B1 * | 7/2002 | Hoffman | A47C 21/044 62/261 |
| 6,945,064 | B2 * | 9/2005 | Jebaraj | F24F 1/025 62/259.1 |
| 9,732,970 | B2 * | 8/2017 | Trevelyan | F24F 7/00 |
| 2002/0121101 | A1 | 9/2002 | Jebaraj | |
| 2008/0264461 | A1 * | 10/2008 | Harris | E04H 15/12 135/120.1 |
| 2013/0143480 | A1 | 6/2013 | Trevelyan | |

FOREIGN PATENT DOCUMENTS

| | | | | |
|---|---|---|---|---|
| CN | 1163735 | | 11/1997 | |
| CN | 203586424 | * | 5/2014 | F24F 1/02 |
| CN | 203586424 U | | 5/2014 | |

* cited by examiner

LOCALISED PERSONAL AIR CONDITIONING SYSTEM

CROSS-REFERENCE TO RELATED APPLICATIONS

This is the U.S. National Stage of PCT/AU2015/050514, filed Sep. 1, 2015, which in turn claims priority to Australian Application No. 2014903758,filed Sep. 19, 2014, and Australian Application No. 2015901307, filed Apr. 13, 2015. The entire contents of all applications are incorporated herein by reference in their entireties.

TECHNICAL FIELD OF THE INVENTION

The present invention relates to a localised personal air conditioning system and to an air conditioning unit for a localised personal air conditioning system.

BACKGROUND OF THE INVENTION

Conventional air conditioning devices work mostly by injecting cool air into an enclosed space in which cooling is desired. The air is injected in a way that results in mixing of the air in the space to achieve a relatively uniform temperature and perceived comfort level at any location in the enclosed space. Usually the air is injected by a fan in the air conditioner through one or more vents at relatively high velocity to create mixing throughout the enclosed space. In a displacement air conditioning system, the air is injected at the bottom of the space to create a cool air layer only in the lower section of the space occupied by people.

The air conditioner removes heat from the air by passing it through a "cold side" heat exchanger containing a cool fluid, or a heat exchanger cooled by some other mechanism such as the Peltier (or thermoelectric) effect. In this specification, the terms "evaporator" and "condenser" respectively refer to the cold side and the hot side heat exchangers. However the scope of the specification is not limited to compressor-refrigeration cooling.

The air inside the cooled space absorbs heat from the walls, floor, people and other objects inside the space being cooled.

Usually, but not always, the air inside the cooled space is recirculated through the cold side of the air conditioner to reduce the energy required to maintain cooling.

The heat absorbed from the cooled space air (including the latent heat obtained by condensing water vapour to liquid water) at the evaporator reappears at the hot side of the air conditioner. Outside air is passed through the condenser and increases in temperature as it absorbs heat from the condenser. The energy used to compress the refrigerant gas also appears at the condenser. Therefore the heat transferred to the warm outside air at the condenser is greater than the heat absorbed from the cooled space air at the evaporator by an amount equal to the electrical energy supplied to the compressor and fans (apart from relatively small amounts of heat lost from the system by other means). The coefficient of performance of the air conditioner is the rate at which heat is absorbed from the cooled space (including the latent heat obtained by condensing water vapour to liquid water) divided by the electrical power supplied to the compressor.

In essence the air conditioner operates as a heat pump, removing heat from air inside the cooled space in the cold side of the air conditioner and transferring this heat, along with the energy used to compress the refrigerant gas, to warmer air outside the cooled space in the hot side of the air conditioner. In the case of a split system air conditioner, the cold side and the hot side are physically distinct components at some distance from each other. In addition to the power required to run the compressor, a small additional amount of power is needed to run the fans to move the inside and outside air.

A portable air conditioner can be constructed from an air conditioner similar to known domestic air conditioners. The air conditioner is usually placed inside the room to be cooled and, therefore, a relatively large diameter air tube is required to ensure that hot air from the condenser is exhausted through a window. In some cases, a second air tube carries air from the window to the condenser circulation fan to be pumped through the condenser. The cool air mixes with the room air or, in the case of some inventions discussed below, is directed into a localized part of the room.

A substantial part of the energy used in these conventional air conditioning arrangements results only in cooling of the building structure and the objects inside the cooled space, and removal of heat entering through the roof or ceiling, walls, floor and particularly through open or covered apertures such as the windows and doors. This energy requirement can be reduced by providing additional insulation or by shading the roof, walls, windows and doors. However, these measures are not always possible, particularly with older buildings not designed with energy efficiency in mind.

By localizing the effect of an air conditioner to just a small section of the cooled space, typically away from doors, windows and walls, very large energy savings are possible. People often spend long periods of time at a single location within a room (such as sleeping on a bed) and it is only necessary to keep the upper body and face cooled for a person to feel very comfortable.

This principle has been described in U.S. Pat. No. 6,425,255 by Karl Hoffman, Dec. 26 2000 (issued Jul. 30 2002). Further refinements are described in US Patent 2002/0121101 by AsirlyaduraiJebaraj, 2 Jan. 2002 (issued 5 Sep. 2002). This patent also refers to China Patents CN2259099 (San Jianhua et al) and CN1163735 (Tan Mingsen et al) that describe air-conditioned mosquito nets in which outside air is conditioned and supplied to the enclosures and all of the air is exhausted outside the enclosure. China patent CN1061140 (He BaoAn et al) describes an insulating mosquito net with a plurality of inflatable air-pocket walls. Chinese developments also include localised air conditioning for seats in an auditorium.

These were preceded by U.S. Pat. No. 2,159,741 by C. F. Kettering et al, 30 Aug. 1933 (issued 23 May 1939) describes a fabric wall structure around the bed and a small air conditioning unit feeding air into the enclosed walled space over the bed. This invention exploited the displacement air conditioning principle in which it is known that cool air is denser than warmer air and thus remains in the walled enclosure over the bed.

Attempting to localize air conditioning by using a mosquito net, even with relatively fine weave, is inefficient. This difficulty was recognized in CN2803143Y in which the interior of the mosquito net is subdivided with an interior curtain such that only the head of the sleeping person is inside the air conditioned section. The slight density difference between cooler air inside the enclosure and the warmer air outside is sufficient to provide a pressure difference that will allow cool air to rapidly disperse through the net into the room. That is why many patents have disclosed impervious barriers to air flow. However, these can be unattractive for people who need to use the enclosure.

It is evident from the above that there is a need for a localised personal air conditioning system in which the conditioned air is used more effectively to cool a person located in a sleeping space.

Uninterruptible power supplies (UPSs) using battery storage have become popular in regions affected by frequent electricity supply interruptions because they are silent and emit no exhaust fumes. A typical UPS can supply power for several hours to operate low power fluorescent lights, communications equipment and a fan. Typical domestic UPS units can supply between 1000 and 2,500 Watts. In many markets, a high power UPS unit costs up to three times the price of the smallest air conditioner and often the batteries need to be replaced every twelve months or so.

An attractive alternative option is to supply power from a photovoltaic solar cell array through an inverter similar to those used for UPS units.

However, a typical UPS inverter cannot easily provide power for air conditioning. The reason is that the electric motor required to run the compressor (as used in a refrigeration air conditioner) draws up to ten times the normal electric supply current for a brief time, typically 50 to 100 milliseconds, when it starts operating from a stationary condition. While UPS units can supply a larger current for a short time without overloading, the power rating of the UPS unit needs to be about three times larger than the electric motor rating in order for the motor to start reliably. Therefore, one would need a UPS unit with a capacity in excess of 2,000 Watts to run even the smallest air conditioners rated at 600 Watts. Here it should be noted that some of the air conditioners said by their manufacturers to run at a relatively low power rating, for instance 450 Watts, actually require up to twice or two and a half times as much power under certain conditions, including when initially starting up. Therefore they typically cannot be run by a UPS system and instead require a generator that can supply the required power.

Many more people would be able to gain comfort and better sleep by using air conditioning if one could reduce the electric power required for the air conditioning compressor. This can be achieved by significantly reducing the cooling capacity required from the air conditioner. One way to do this is to localize the effect of the air conditioner so that only the air around the head and upper body is cooled.

A further, related problem also exists in the field. In order to achieve such a precisely localised cooling effect on a person from a reasonable distance, the cooling effect of a jet of air should be able to extend some distance from the origin of the jet. This is difficult because any turbulence in the jet is likely to promote mixing with the surrounding air, thereby reducing the velocity, and subsequently reducing the cooling sensation at the location of the person. As it turns out, the jet velocity at the location of the person is significant. For example, if the jet velocity exceeds 0.4 m/s, an additional apparent cooling of approximately 2° C. can be attained, due to the way in which the human physiology senses the apparent temperature of the surrounding air.

For a heat exchanger to operate at maximum heat transfer efficiency, a relatively uniform air velocity is required. If there is a large difference in air velocity in different parts of the heat exchanger, this reduces the effective heat exchange area, resulting in a greater temperature difference between the air in the evaporator tubes and the average temperature of the air after it passes through the heat exchanger. This means that more work needs to be done by a refrigeration compressor to achieve the same cooling effect.

The disadvantage of arrangements provided in the prior art is that air passing through the cooling side of the air-conditioner must be pushed through the evaporator heat exchanger by an air circulating fan. If a motor driven used to force air through the cold air side of an air-conditioner is located adjacent to the heat exchanger, it is difficult to achieve uniform air velocity through all parts of the heat exchanger because air leaves different parts of the fan at different velocities and sometimes different directions, depending on the design of the fan. Moreover, the air exiting the fan has significant vorticity, which can cause additional turbulence, causing the air jet to mix rapidly with the surrounding air.

In order to achieve a more uniform velocity, air-conditioner arrangements having the air pass through the heat exchanger before passing through the fan are often preferred. Undesired vorticity can be reduced through the provision of airflow straighteners. However, air flow straighteners known in the field present manufacturing challenges and have costly parts, taking up a relatively large amount of space. Any attempt to provide a practical, personal localised air conditioner is preferably compact and low-cost.

It is generally desirable to overcome or ameliorate one or more of the above mentioned difficulties, or at least provide a useful alternative.

SUMMARY OF THE INVENTION

According to the present invention, there is provided an air conditioner system including:

(a) a sleeping enclosure defining a sleeping space into which conditioned air is adapted to be delivered from one end or side of the sleeping space in a manner which maximizes contact between the conditioned air and a person or persons in the sleeping space, the sleeping space including:
  (i) an upper air pervious section; and
  (ii) a lower relatively air impervious section adapted to surround a bed in the sleeping space and configured to minimize passage of the conditioned air from the sleeping space through the pervious section or other leakage paths; and (b) an air conditioner unit for generating a conditioned air flow, wherein the impervious section extends to a height above the sleeping surface of the bed at the end or side of the bed opposed to said end or side sufficient to contain the conditioned air as it moves towards and returns from the opposite end or side of the sleeping space, and wherein the impervious section extends to a sufficiently increased height above the sleeping surface at the opposite end or side to allow the direction of air flow to reverse towards said one end or side without substantial loss of conditioned air through the pervious section.

Preferably, the sleeping enclosure is a tent enclosing the sleeping space and inhibiting insects such as mosquitoes from accessing the skin of the people inside the enclosure. Preferably, the tent is quick-erecting and self-supporting.

The systems, devices or units described herein may include an adapter. The adapter may act as a conduit joining the air conditioner unit with the internal space of the enclosure. The adapter may include a tent connecting end section coupled to a panel of the tent and an air conditioner connecting end section coupled to the air conditioner unit. The adapter may be substantially comprised of impervious fabric. The adapter may form the return air take. The adapter may enclose an air projector nozzle of the air conditioner unit. The adapter may allow for the enclosure to be used with mattresses with different heights above a floor level, even though the air cooler is supported by the floor. The adapter may be manufactured as an extension of the enclosure, or may be detachable.

The air conditioner connecting end section may comprise an opening that is smaller than the opening of the tent connecting end section, so that the adapter trumpets out from the air conditioner unit.

The adapter may be made with one or two layers of impervious fabric with an insulating layer in order to inhibit condensation in humid weather conditions. The insulating layer may be made from flexible foam material.

The present invention also provides an air conditioner unit for generating a conditioned air flow for an air conditioner system including a sleeping enclosure defining a sleeping space into which conditioned air is adapted to be delivered from one end or side of the sleeping space in a manner which maximizes contact between the conditioned air and a person or persons in the sleeping space, the enclosure including an upper air pervious section and a lower relatively air impervious section adapted to surround a bed in the sleeping space and configured to minimize passage of the conditioned air from the sleeping space through the pervious section or other leakage paths, the air conditioner unit including:

(a) a heat emitting side including:
  (i) a room air inlet;
  (ii) a condenser fan;
  (iii) a condenser heat exchanger; and
  (iv) a hot air outlet a hot air outlet located on a top side of the unit for directing hot air in an upward direction; and
(b) a heat absorbing side including:
  (i) the return air inlet;
  (ii) an evaporator fan;
  (iii) an evaporator;
  (iv) air straightener;
  (v) a cold air outlet located in an upper section of the unit; and
  (vi) a curved cold air deflector coupled to the cool air outlet which acts as a conduit for directing the cold air flow towards a person or into the bed enclosure for the sleeping application when arranged in an open condition; and
(c) a motor for driving the evaporator fan and the condenser fan.

Preferably, the evaporator fan passes air through the air straightener which comprises a series of vanes designed to reduce the exit air velocity and also to ensure that the airflow is sufficiently straightened to avoid unwanted mixing between colder air just above the sleeping surface and warmer layers of air above. Preferably, the series of vanes is designed to reduce the exit air velocity to less than 4 m/s.

The present invention also provides an air conditioner system including:

(a) a sleeping enclosure defining a sleeping space into which conditioned air is adapted to be delivered from one end or side of the sleeping space in a manner which maximizes contact between the conditioned air and a person or persons in the sleeping space, the means defining the sleeping space including:
  (i) an upper air pervious section; and
  (ii) a lower relatively air impervious section adapted to surround a bed in the sleeping space and configured to minimize passage of the conditioned air from the sleeping space through the pervious section or other leakage paths; and
(b) an air conditioner unit as claimed in any one of claims 19 to 33, for generating a conditioned air flow, wherein the impervious section extends to a height above the sleeping surface of the bed at the end or side of the bed opposed to said end or side sufficient to contain the conditioned air as it moves towards and returns from the opposite end or side of the sleeping space, and wherein the impervious section extends to a sufficiently increased height above the sleeping surface at the opposite end or side to allow the direction of air flow to reverse towards said one end or side without substantial loss of conditioned air through the pervious section.

Preferably, the sleeping enclosure is a tent completely enclosing the sleeping space and inhibiting insects such as mosquitoes from accessing the skin of the people inside the enclosure.

The present invention also provides a localised cooling device including:

(a) an air conditioner unit comprising a room air inlet, a condenser fan, a condenser heat exchanger, a hot air outlet for directing hot air in an upward direction, a return air inlet, an evaporator fan, an evaporator and a cold air outlet;
(b) an airflow straightener for receiving air from the cold air outlet;
(c) a curved cold air deflector which acts as a conduit for directing cold air flow from the airflow straightener towards a person; and
(d) a motor for driving the evaporator fan and the condenser fan.

Preferably, the curved cold air deflector is in the form of a nozzle. Preferably, the condenser fan and the evaporator fan are centrifugal fans. Preferably, the centrifugal fan has a backward sloping impeller.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
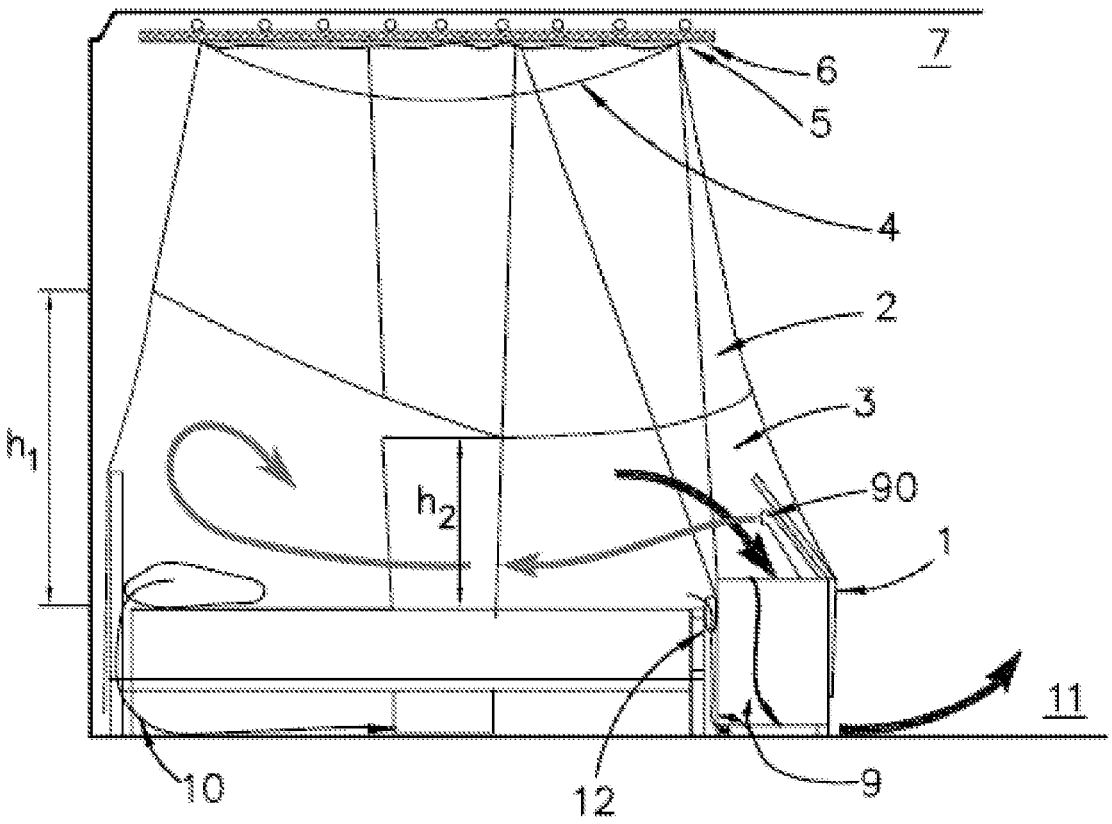
FIG. 1 is a schematic side elevation of a system embodying the invention.

The outlet of the air conditioner (1) in the embodiment described directs a stream of cool air over the bed as shown in FIG. 1. Air returns to the cooler from the enclosed space and enters by a return air intake near the top of the unit. Air to cool the condenser is taken from the room air outside the enclosure at floor level and ejected at the back of the unit, also near floor level (11). The room windows should normally be left open allowing warm air from the air cooler to escape.

This overcomes a significant disadvantage of normal room air conditioners. When a room air conditioner is used, the windows must be closed. Many people dislike this and would prefer fresh air from the outside. This invention allows for the room windows to be left open. Even if they are closed, there is minimal warming of the room caused by the relatively small amount of heat released from the air conditioning unit: the net heat released to the room is only the electrical power consumption of the compressor and fans.

The means of localizing the air conditioning effectively permits this embodiment to be used outside in the open air, unlike a normal air conditioner.

When the hinged lid at the top of the unit is lowered, all air inlets and outlets are invisible and protected from dust accumulation. The air conditioning unit, therefore, resembles a normal piece of bedroom furniture when it is not in use.

Referring to FIG. 1, the fabric enclosure consists of two sections. The upper section (2) is made from a fabric suitable as an insect screen and air can pass through this fabric very easily. The lower section (3) is made from a relatively impervious fabric that also has a greater weight per unit area. The lower section of fabric retains the cool air over the bed.

In the arrangement shown in FIG. 1, the air cooler unit (1) is located at the foot end of the bed to keep the source of noise as far from the ears of the sleeping person as possible. The height $h_1$ of the impervious fabric above the mattress at the head end of the bed needs to be at least about 1000 mm. At the foot end of the bed the height $h_2$ needs to be at least about 600 mm. The additional height at the head end is required because the air stream coming from the cooler unit slows down, increasing the static pressure of cool air as predicted by Bernoulli's law. Without this additional height, the cool air would overflow the wall of impervious fabric resulting in unwanted loss to the warmer room air outside. The bottom of the impervious fabric hangs just above the floor level.

Figure 2:
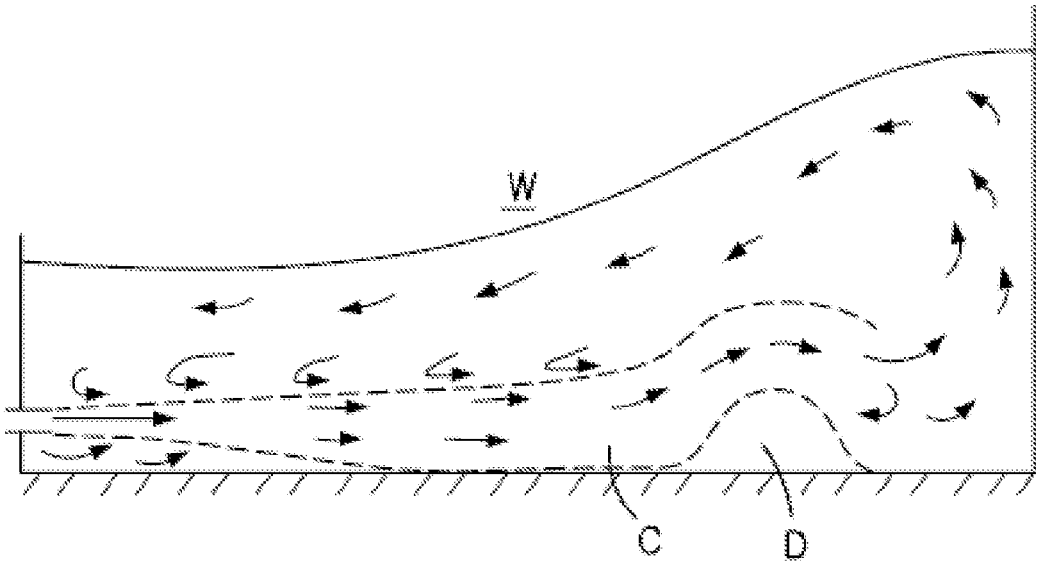
FIGS. 2 and 3 are a simplified representation of air flow where the air enters the left end.

A jet of cool air emerges from the air cooler outlet 90 at about 2.4 metres per second (m/sec). The outlet flow rate is typically about 30-40 litres per second (l/sec), and the temperature is between about 12° and 18° . By using Bernoulli's famous equations that describe incompressible fluid flow, one can show that the static pressure of the cool air jet is lower than the surrounding air. As a result, shown in FIG. 2, surrounding warmer air W tends to mix with the faster moving cool air C. Momentum must be conserved during this mixing process so, while the average velocity decreases with distance from the outlet 90 because of mixing, the total mass of air in the moving jet increases, being the combination of the cool air from the jet and a portion of the surrounding air that has mixed with the cool air and by now is moving with the cooler air. We can estimate the air flow at this location by observing that the velocity is now around 0.4 m/sec. The total air flow (cool air plus warmer air that has mixed with it) is now around 180-200 l/sec. Measurements show that this air mixture is typically between 5° and 7° cooler than ambient air in the room. As this air is denser than the ambient room air, it displaces the warmer cooler air upwards, as shown in FIG. 2.

The cool air reaches the end of the enclosure and has to stop moving horizontally. The depth of cool denser air is greater here.

The depth difference can be calculated from fundamental principles: the same principles that Bernoulli used for his famous equations that describe incompressible fluid flow. The reason for working from fundamental principles is that conventional fluid mechanics texts provide equations that describe the flow of water (or similar fluids) in channels, neglecting the density of the air above. This is reasonable because the air is usually around 800 times less dense than water.

However, in the case of the cool air within the enclosure, the warm air above is only slightly less dense than the cooler air at the bottom. Measurements show, in addition, that there is no clear boundary between the cool air and the warmer air. Instead there is a gradual transition from warmer air to cooler air over a distance of about 0.2-0.4 m. However, we can simplify the calculations by assuming that there is a distinct measurable boundary and still obtain results with sufficient accuracy.

Figure 3:
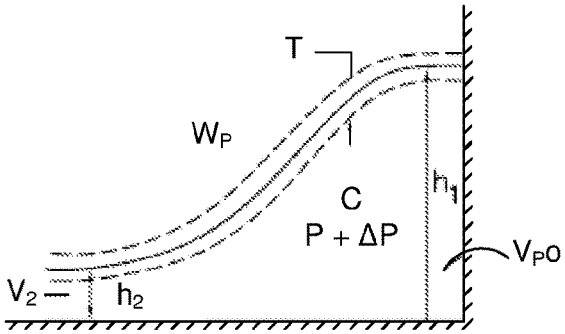

A small elemental volume of air close to the head end has potential energy represented by the greater depth of cool air (with higher density). Away from the head end, the depth of cool air is less and this difference causes two effects. First, the air at the head end needs to recirculate back to the foot end of the bed. Second, the cool air flowing over the head and shoulders of the occupant slows down and starts moving up instead. We treat this phenomenon by equating the kinetic energy of the air in motion to the potential energy difference represented by the different depth of cool air, illustrated in FIG. 3.

A small volume of moving air, dv, has mass $\rho_i$, dv where $\rho_i$ is the density of the cool air inside the enclosure. The kinetic energy of this small volume of air is therefore $0.5\rho_i$ dv $u^2$ where u is the velocity, mostly in the horizontal direction. The potential energy represented by the increased depth of cool air at the head end is also easily calculated. For our small volume at rest, near the head end, the potential energy is $(\rho_i-\rho_a)$ dv g $(h_1 - h_2)$. Here we use the density difference between the cool air $(\rho_i)$ and the ambient air $(\rho_a)$ because it is this difference that creates the small pressure difference that affects the air velocity. We can equate these two:

$$0.5_{\rho i} dv\ u^2 = (\rho_i - \rho_a) dv\ g(h_1 - h_2) \quad (1)$$

Noting that dv appears on both sides of the equation, we can eliminate it. Thus we can re-arrange the equation and calculate u from:

$$u = (2(\rho_i - \rho_a) g(h_1 - h_2)/\rho_i)^{0.5} \quad (2)$$

Substituting the values described above, we obtain the following calculated results:

| | | | | |
|---|---|---|---|---|
| Gravitation acceleration | g | 9.81 | m/sec^2 | |
| Level of cool air above head end | head_level | 0.9 | m | |
| Level of cool air above mid point | mid_level | 0.4 | m | |
| Air density @ 20 degrees | Rref | 1.293 | kg/m^3 | |
| Ambient temperature | Ta | 35 | degrees C. | |
| Enclosure air temperature | Ti | 30 | degrees C. | |
| Air density of enclosure air | Ri | 1.25 | kg/m^3 | Rref * 293/(Ti + 273) |
| Air density of ambient air | Ra | 1.23 | kg/m^3 | Rref * 293/(Ta + 273) |
| Density difference | delta_R | 0.02 | kg/m^3 | Ri − Ra |
| Estimated velocity u2 | u_mid | 0.40 | m/sec | (2 * delta_R/Ri * g * (head_level-mid_level))^0.5 |

What this demonstrates is that if the difference in depth of cool air is 0.5 m, then the expected flow velocity associated with that depth difference is 0.4 m/sec that is what we observe in tests.

The cool air needs to recirculate within the enclosure, partly to provide enough air velocity to create an additional perception of comfort, and partly because the air will be entrained in the jet of conditioned air entering the bed enclosure from the cool air outlet. We can calculate how much space is required for this circulation.

The total flow of mixed cool air over the head and shoulders of the occupant O is about 180 l/sec. At a velocity of 0.4 metres/sec this requires a flow area of 0.46 $m^2$. In fact, the velocity cannot be uniform, so a larger area will be needed, typically around 50% more. Using the measurements obtained to estimate the depth of cool air flowing over the head and shoulders of the occupant; this depth is about 0.3 m. The width of the bed is about 1.8 m, and we need almost this full width to accommodate this flow. Therefore we can conclude that the return air flows over the top of this cooler air layer back to the foot end of the bed. The combined thickness of these two layers needs to be, therefore, about 0.6 m. This corresponds to the observations from experiments. The typical depth of cool air at the head end is around 0.9-1.0 m and at the mid section about 0.4-0.5 m. When we allow for the transition layer between cool and warm air above, we need to allow more depth, and the minimum required will be about 0.1 m greater than these values.

It should be noted that a typical width across the shoulders of a person is 0.45 m. With an occupant sleeping on their side, the shoulder height is greater than the thickness of the cool air layer flowing towards the head end of the bed. However, just as running water flows up and over submerged rocks in a stream, the cool air will flow over the shoulders of the occupant. This will cause some friction flow losses however, but these do not significantly affect the levels of cool air within the enclosure.

An alternative arrangement would be to admit cool air at one end of the bed, say the head end, and extract air from the foot end of the bed to be cooled and recirculated. However, first one has to allow 0.2-0.4 metres transition layer between warm air above and cool air below. Then one has to allow sufficient depth for the air flow to rise over the shoulders of an occupant sleeping on their side, 0.45 m high. This means that the minimum depth of cool air in the enclosure has to be around 0.5 m (0.6 m after allowing for the transition layer). If the impervious part of the fabric curtain containing the cool air is lower than 0.6 m, cool air will overflow the sides of the curtain, significantly reducing the efficiency of the air cooling. In addition significant ducting will be needed to transport the air from one end of the bed to the other end. This ducting is a further source of heat gain due to conduction, reducing the efficiency. Since it is desirable to admit cool air at the head end in this arrangement, there is a further problem that the occupant's ears are closer to the air cooler sound sources, making noise more apparent.

The fabric enclosure may be made in several sections sewn permanently together. One section 4 made of insect screen material forms the top of the enclosure. Four overlapping hanging sections made from insect screen material at the top (2) and impervious fabric at the bottom part (3) are sewn to the top section in such a way that they overlap horizontally by at least 1000 mm at the top, preferably more. Each piece forms part of the end of the enclosure (either the foot end or the head end) and part of the sides, thereby providing access openings in the ends and the sides. Additional material may need to be gathered at the corners and particularly at the foot end of the bed to allow enough fabric to enclose the air conditioner unit.

Fabric hangs over the sides and ends of the bed to form a continuous air and insect barrier, yet still providing convenient side openings for people to enter or leave the enclosed space.

The overlapping fabric at the openings improves thermal insulation between the enclosure and the outside room air.

Fabric ties sewn to the seam joining the top piece and side pieces enables the fabric enclosure to be attached (5) to supporting light weight rods (6) made from metal, wood or bamboo, for example. The rods are suspended from the ceiling (7) such that they are small distance inwards from a position directly above the edges of the bed. By this means the fabric hangs against the sides and ends of the bed forming an effective barrier to prevent air from cascading over the sides and ends of the bed.

A long tube of lightly stuffed fabric about 100 mm in diameter forms a sealing piece between the air conditioner unit and the bed (12). This also helps to anchor the enclosure fabric in place around the sides of the air conditioner unit to prevent leakage (9, 10) of the air between the enclosure and the warmer room air outside.

During the day, the four hanging sections of the enclosure can be drawn apart and tied to allow convenient access to change or air the sheets and make the bed. The air conditioning unit, being mounted on castors, can be moved near to a work desk where the user can be cooled during the day time.

Since the power consumed by the air conditioner is very low, it is suitable to be powered by solar cells of modest size and cost, particularly if coupled to battery storage for night time operation.

Measurements have revealed that a small air conditioner running with an input power of 270 Watts and cooling the enclosure described provides a temperature reduction of about 5° when the room temperature is 35° and humidity is about 50%. The effect of air movement in the enclosure adds an apparent temperature reduction of 2° enabling the unit to meet the comfort requirements established by research. This is achieved by using a cool outlet air vent that supplies cool air to the enclosed space through an air straightener, reducing turbulence in the outlet air stream. This enables the air conditioner to maintain an air flow velocity across the bed that is around 2 metres per second near the outlet air vent, and about 0.4 metres per second at the head end of the bed, sufficient to achieve the apparent 2° cooling.

Figure 4:
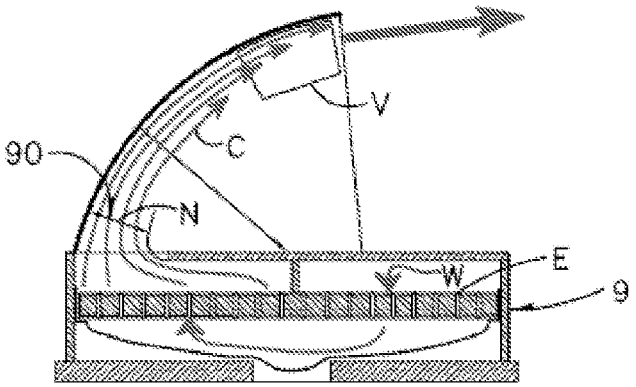
FIG. 4 is a schematic sectional elevation of a suitable projector nozzle.

In an alternative arrangement illustrated in FIG. 4, the evaporator E itself can be used as the flow straightener as it has a multiplicity of closely spaced fins. By arranging for the air flowing from the evaporator to be redirected by the inside of a curved outlet nozzle with a radius of curvature of about 25 cm, the outlet air stream can be directed at a person up to 2 metres from the outlet with minimal turbulence.

Remotely controlled vanes V provide a means of adjusting the direction of the cool air jet.

The arrangement of the return air intake to the air cooler needs careful consideration. The cross section area of the intake and the air flow rate together determine the average velocity of air entering the intake. The maximum entry velocity near the middle of the intake will be slightly higher because the air velocity at the edges will be lower than the average velocity.

The depth of cool air with higher density in the enclosure provides a relative pressure difference to accelerate the air to the intake velocity, by Bernoulli's principle. If the intake air velocity is too high, this pressure will be insufficient. When this happens, warm air above the cool air layer will be sucked into the intake along with a proportion of cool air, in the same way that air can be entrained with the water stream draining from a bath when it is not quite empty. This increases the average temperature of the intake air, reducing the cooling efficiency of the air cooler.

Figure 5:
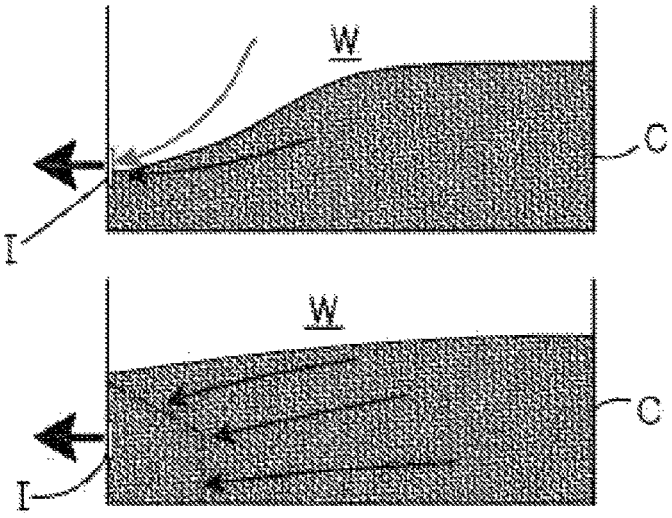
FIG. 5 schematically illustrates the effect of air intake arrangement simple air inlet, a fabric air filter and inlet diffuser.

FIG. 5 illustrates this and shows cool air C trapped inside an enclosure, such as the fabric enclosure that is the subject of this embodiment. In the upper arrangement, a small air intake I removes cool air from the inside of the enclosure. A high exit velocity is required due to the small area of the air intake. The pressure of cool air is insufficient and warm air W enters the air intake as a direct result. The lower arrangement of FIG. 5 shows a pervious fabric diffuser intake with a much greater surface area, shown with a dotted line, also serving as an air filter. Because the entry velocity to the fabric diffuser is much lower, the pressure required to accelerate the air through the intake is much less. Sufficient pressure for this is available from the depth of cool air inside the enclosure. Therefore, no warmer air enters the air intake and the operating efficiency of the air conditioner is improved.

The fabric area must be large enough to keep the inflow velocity to about 0.1 m/sec (approximately 0.4 square metres for a flow of 40 litres per second). This is essential to prevent the warm air layer above the cool air from being drawn into the air intake, as explained above.

Alternative Air Conditioner 100

Figure 6A:
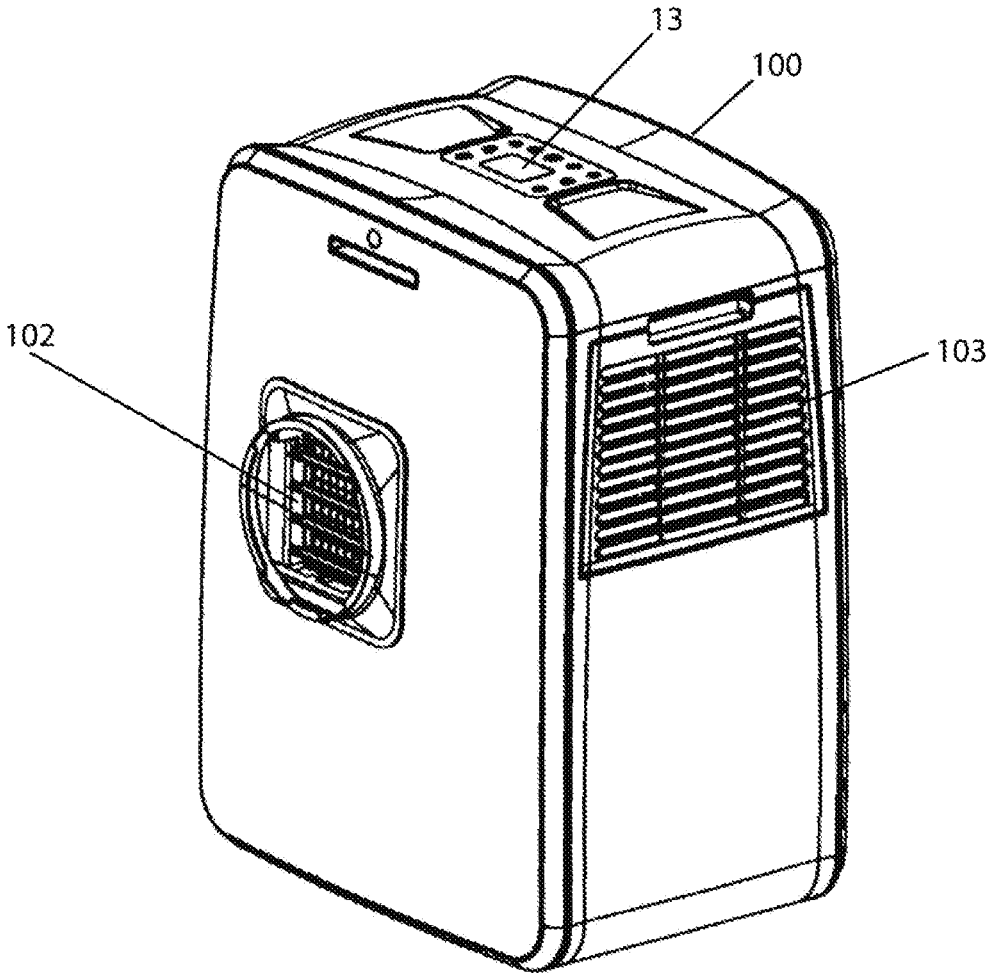
FIG. 6*a* is a side perspective view of a portable air conditioner manufactured by United International.
Figure 6B:
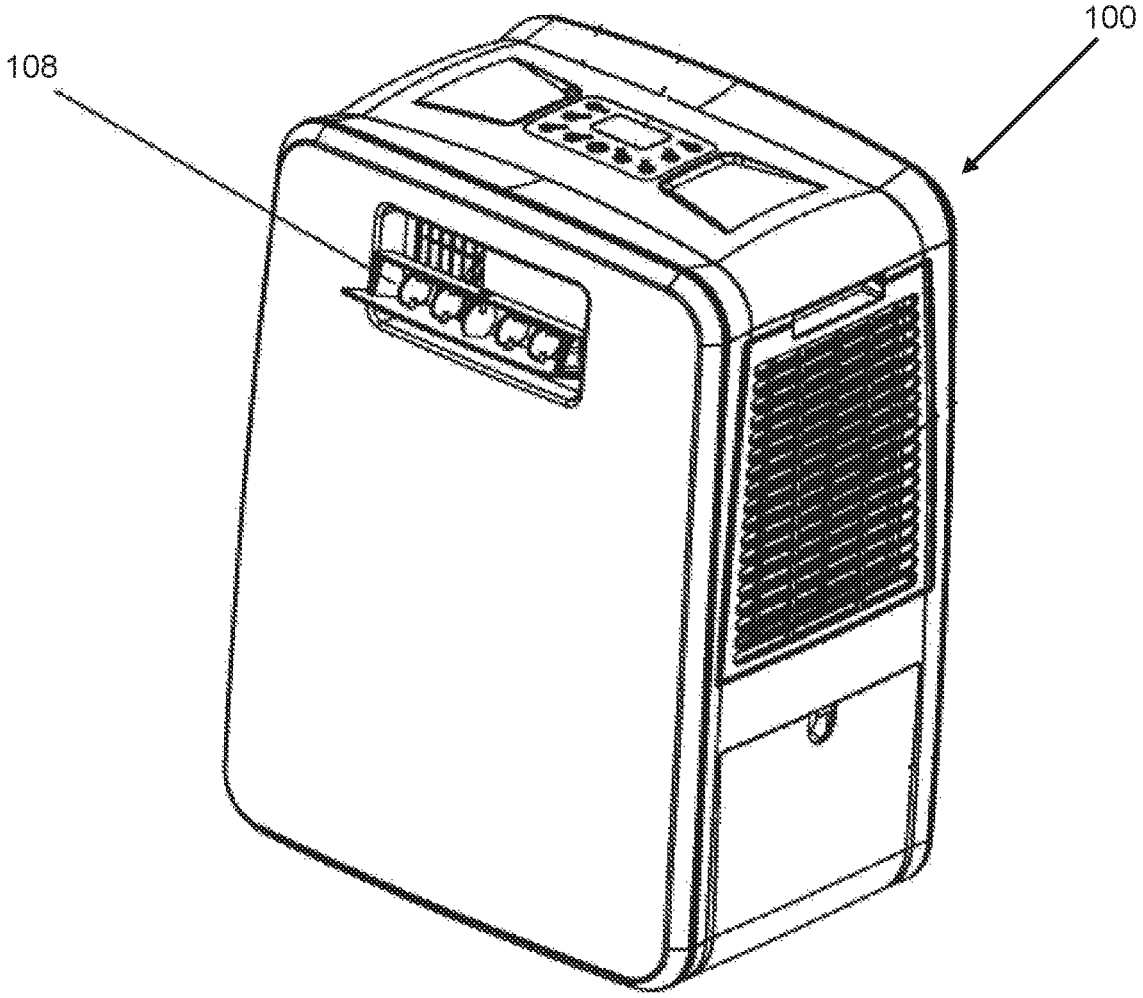
FIG. 6*b* is another side perspective view of the unit shown in FIG. 6*a* with a first part of the housing removed.
Figure 6C:
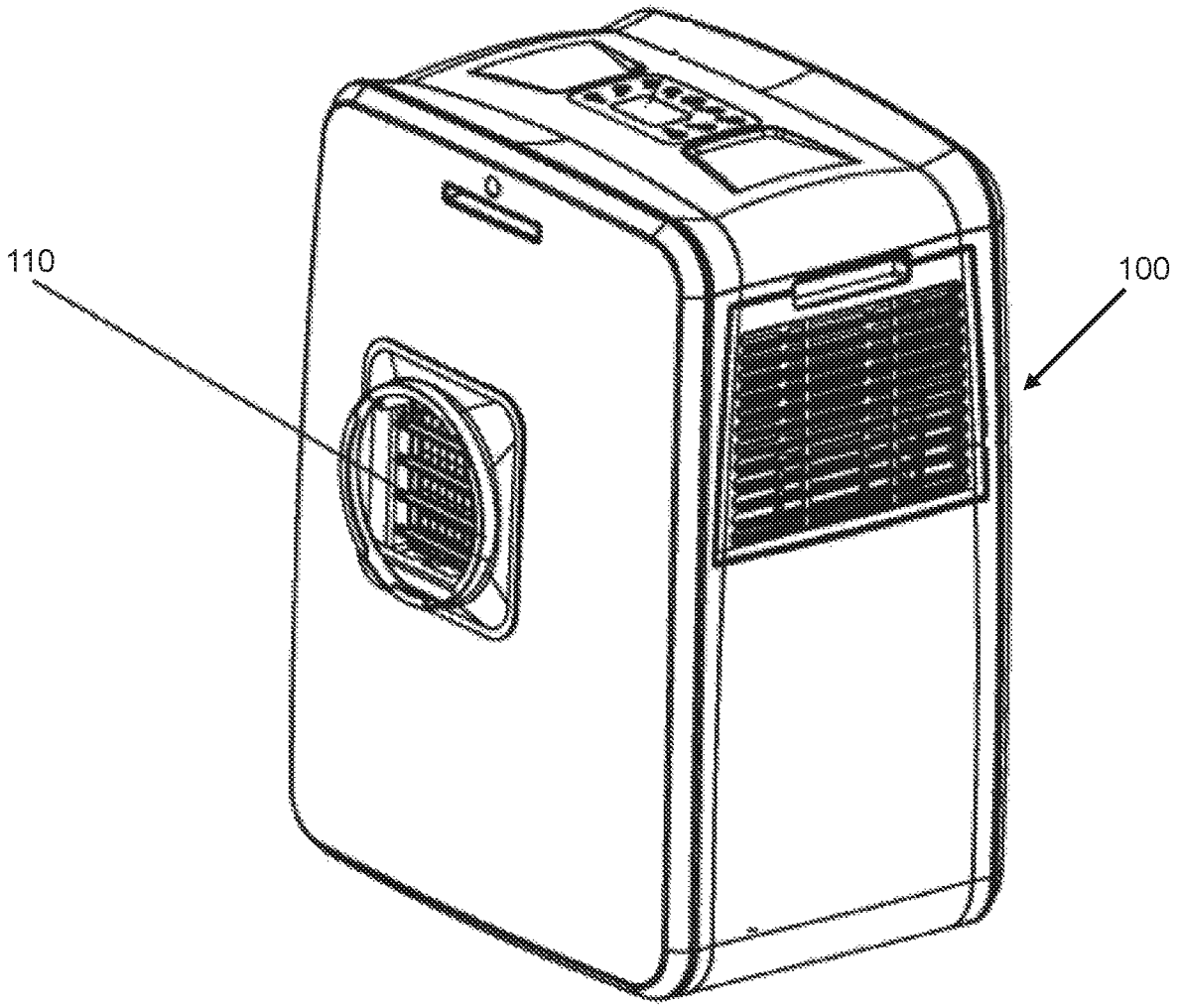
FIG. 6*c* is another side perspective view of the unit shown in FIG. 6*a* with a second part of the housing removed.

The air conditioner 1 could alternatively be replaced with an improved air conditioner unit 100 shown in FIGS. 6*a* to 6*c*. This air conditioner unit 100 is the subject of CN 203586424U. The disclosure of CN 203586424U, including the operation of the air conditioner unit 100, is incorporated herein by way of reference.

Figure 9:
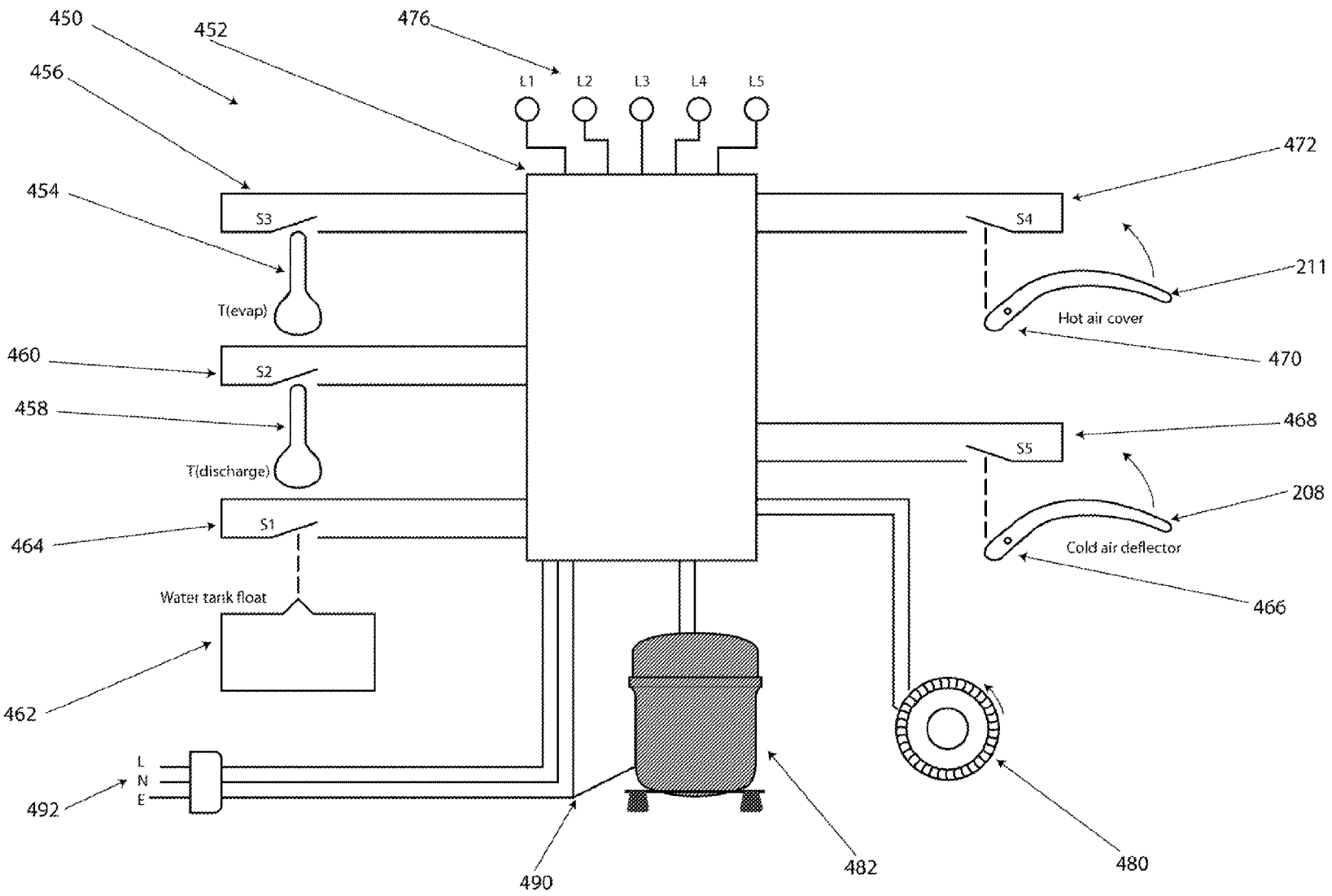
FIG. 9 is a schematic diagram of an electrical system of the air conditioner unit shown in FIG. 7*a*.

CN 203586424U, in essence, describes an air conditioner unit 100 that has particular means of evaporating water that is condensed at the cold evaporator, the heat absorbing component of the air-conditioner. The water is evaporated by spraying it in the form of small drops over the hot heat emitting condenser heat exchanger coils. A copy of this patent is attached. FIGS. 9, 10, and 11 of CN203586424U illustrate a small wheel that sprays water up from the mid-level water collection tray. The water is sprayed into a gap between the condenser heat exchanger coils. Alternatively, the water can optionally be diverted so it can be collected in a holding tank inside the unit.

Improved Air Conditioner 200

Figure 7A:
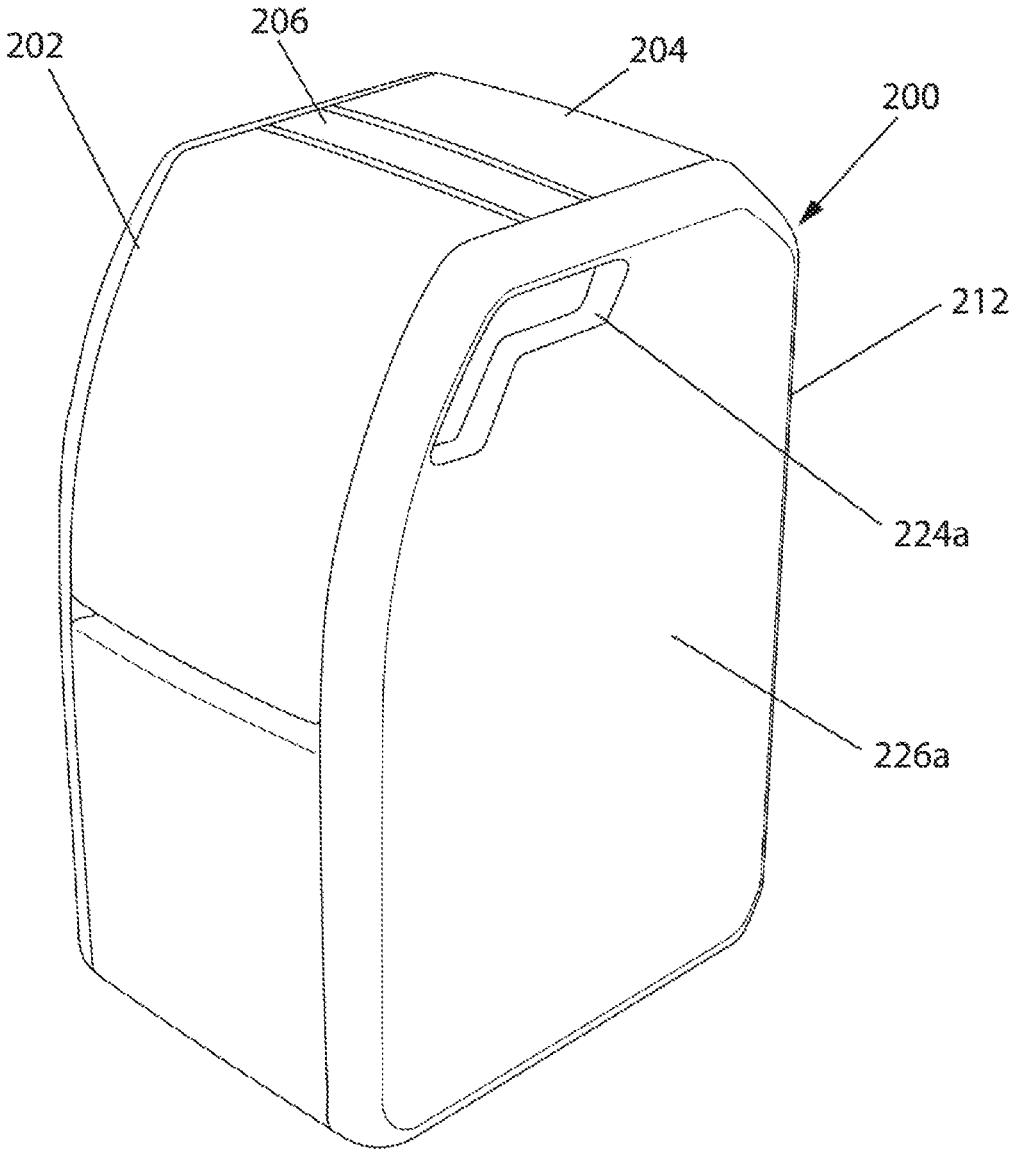
FIG. 7*a* is a right side perspective view of a portable air conditioner in accordance with a preferred embodiment of the present invention.
Figure 7B:
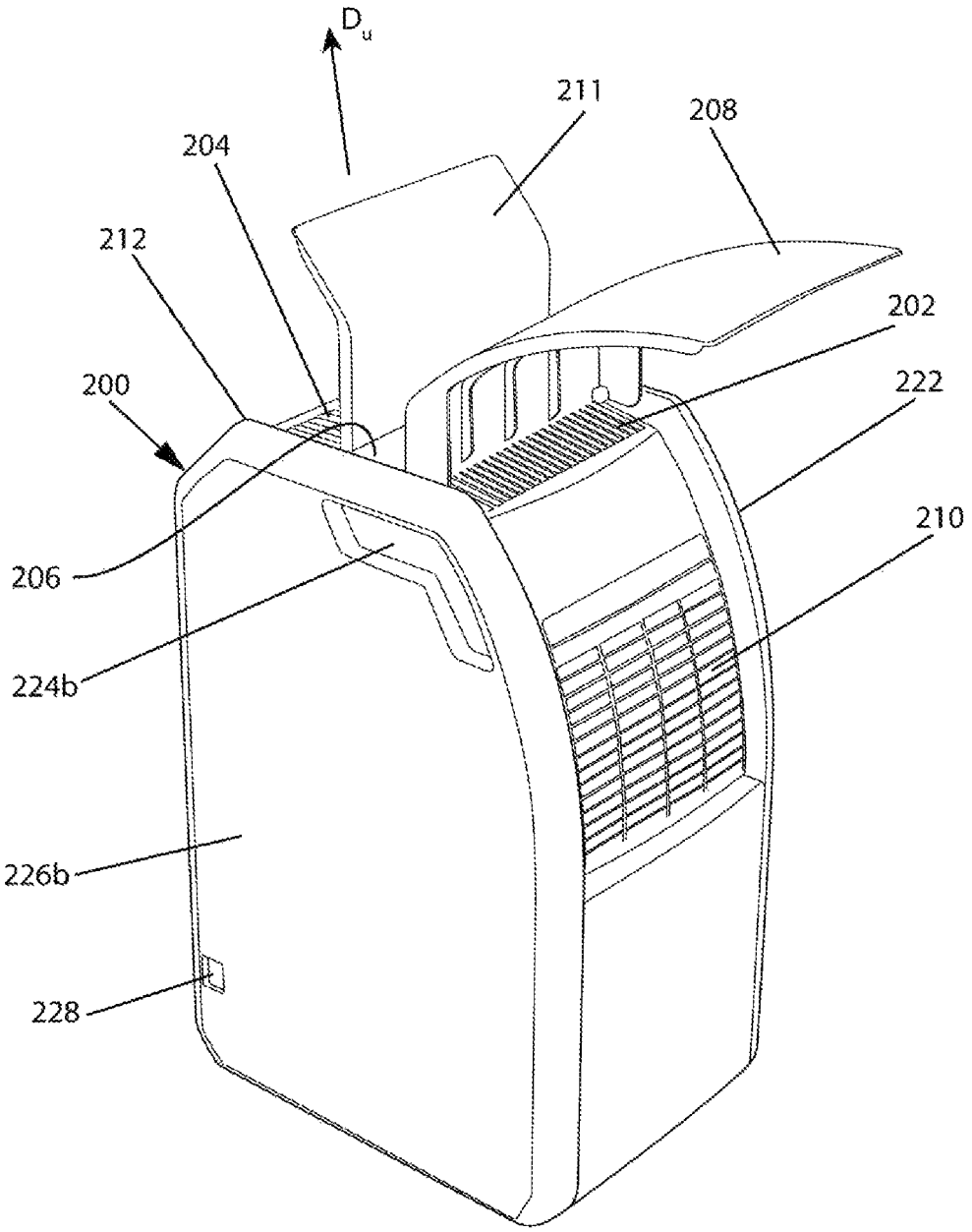
FIG. 7*b* is a left side perspective view of a portable air conditioner shown in FIG. 7*a* arranged in a different condition of use.

Alternatively, the air conditioner 1 could be replaced with the air conditioner unit 200 shown in FIGS. 7*a* and 7*b*. The air conditioner unit 200 improves upon the design of air conditioner unit 100. To this end, the air conditioner unit 100 had the following deficiencies when used for cooling a person sleeping in the above-described enclosure around a bed 12:

1. the cold air from the heat absorbing side of the air-conditioner emerged from a small duct at very high velocity (approximately 13 m/s) at the side of the unit (cold air outlet 108); and
2. the hot air from the heat emitting side of the air-conditioner emerged on the other side of the unit (hot air outlet 110), also at high velocity.

In the improved air conditioner unit 200, both the cold air and hot air to emerge from respective outlets 202, 204 in the top 206 of the unit 200 at lower velocity when compared with the unit 100. The cool air outlet 202 includes a curved air deflector 208 at the top 206 of the unit 200. The deflector 208 serves as:

1. a protective cover for the cold air outlet 202 and the return air inlet 210 of the unit 200 when arranged in the closed condition of use shown in FIGS. 7*a*; and
2. as a conduit for directing the cold air flow towards a person or into the bed enclosure for the sleeping application when arranged in the open condition shown in FIG. 7*b*.

Experimental testing evidenced that it is important to direct the hot air from the heat emitting side 212 of the air-conditioner unit 200 in an upward direction "$D_U$" so that people in the room with the bed 12 are not as aware of the heat coming out of the air-conditioner 200 as they otherwise might have been. This is in contrast to the air conditioner 1, where the hot air emerged at floor level 11 in a horizontal direction. The hot air outlet 204 includes a deflector 211 positioned to direct hot air vertically away from the outlet 204. The deflector 211 also deflects hot air away from the cool air outlet 202 and there by inhibits heating of the cooled air coming out of the unit 200.

Although the heat from the duct of the unit 1 did not result in any perceptible change in room temperature, the psychological effect on people in the room experiencing this flow of hot air created the sensation that the room was getting hotter. The reason why this heat does not cause the room temperature to be increased is that almost the same amount of heat is being absorbed by the cold side of the air-conditioner at the same time.

The air conditioner unit 1 included an air projector nozzle 90 coupled with an air straightener. However, the nozzle 90 was linked this with the use of the evaporator heat exchanger as the airflow straightener in the manner shown in FIGS. 1 and 2.

Figure 8:
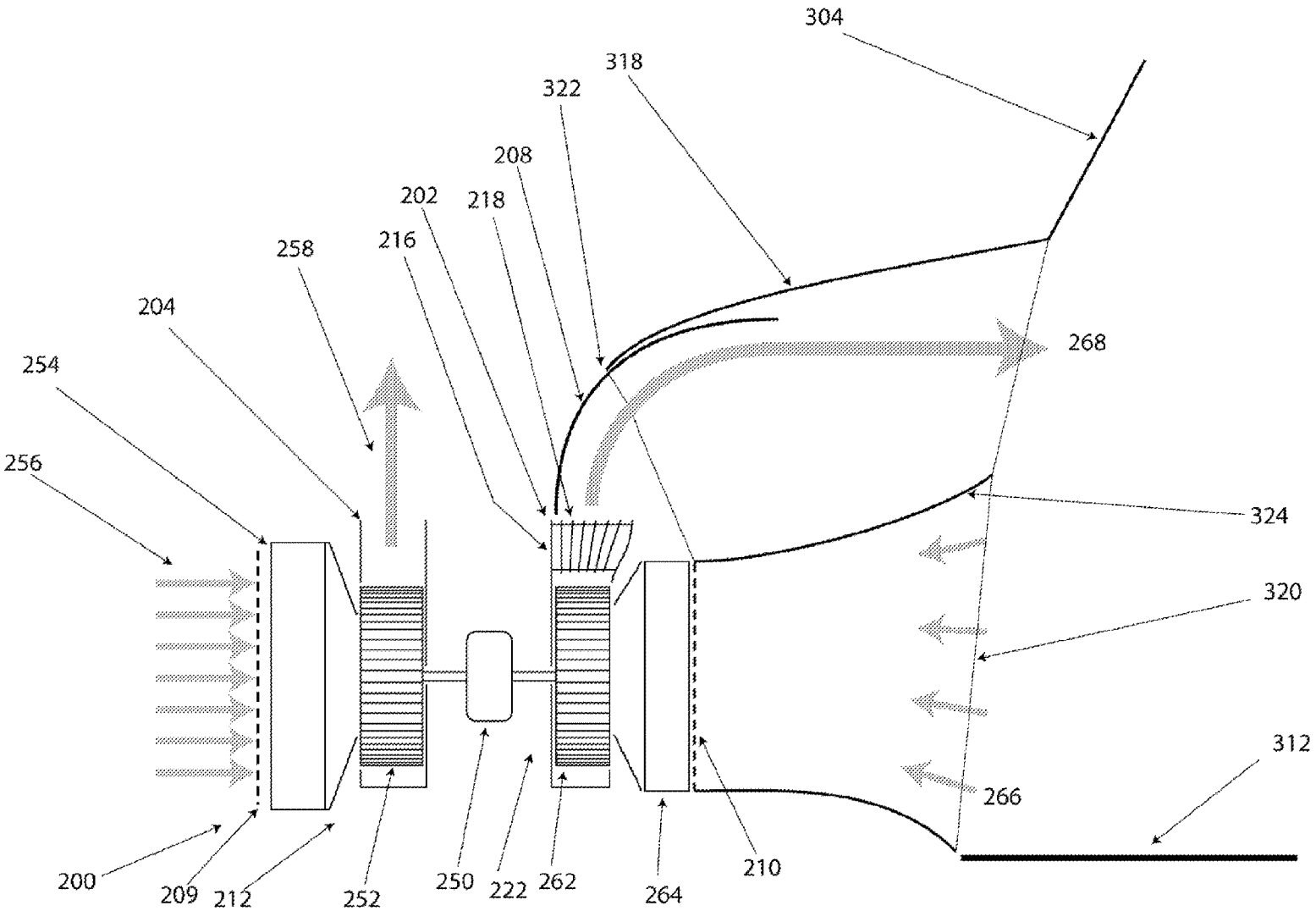
FIG. 8 is a schematic diagram of the air conditioner unit shown in FIG. 7*a;*

Whereas in the air conditioner unit 200, as shown in FIG. 8, air from a fan 262 inside the air conditioner 200 passes through an air straightener 216 comprising the series of vanes 218 designed to reduce the exit air velocity to less than 4 m/s and also to ensure that the airflow is sufficiently straightened to achieve this result. To this end, the air emerges at the cold air outlet 202 at the top 206 of the air cooler 200 and is deflected with the curved air deflector 208 that also serves as a protective cover for the air inlet 210 when the cooler 200 is not in use.

As particularly shown in FIG. 8, the hot heat emitting side 212 of the air-conditioner 200 includes:

a. the room air inlet 209;
b. the condenser fan 252
c. a condenser heat exchanger 254; and
d. a hot air outlet 204.

Air from the room is drawn through the room air inlet 209 at the back of the air-conditioner 200 into the condenser 254 by the fan 252. Air from the fan leaves through the hot air outlet 204 near the top and back end of the air-conditioner 200.

The heat absorbing side 222 of the air conditioner 200 includes:

a. the return air inlet 210;
b. the evaporator fan 262;
c. the evaporator 264;
d. the air straightener 216;
e. the cold air outlet 202; and
f. the curved cold air deflector 208.

A motor 250 drives the evaporator fan 262 and the condenser fan 254. These fans can be driven by separate motors if separate speed control is desired.

Air flow through the unit 200 is described below in further detail with reference to the enclosure 306 of the air conditioning systems 300 and 500.

Advantageously, the air conditioner unit 200 is self-contained and the hot air from the condenser 220 is discharged into the room, outside the enclosed sleeping space. It is possible to do this because the electric power used to operate the heat pump function of the air cooler 200 is sufficiently low that discharging this amount of heat does not significantly affect the room temperature. The net difference between the heat absorbed in the cold side 222 of the air-conditioner 200 and the heat emitted at the hot side 212 of the air-conditioner 200 is exactly equivalent to the electric power used operate the heat pump function, this being determined by the laws of thermodynamics and energy conservation. This heat, when discharged into the room, causes an imperceptible temperature rise in the room.

However, from a psychological point of view, it is important to minimise any accidental contact between people using the room and the hot air emerging from the heat emitting side 212 of the air conditioner 200. Therefore, this hot air is discharged in a stream directed substantially vertically upwards from the air cooler 200 by the outlet 204 so that it is not apparent even to people walking past the air conditioner unit 200 at the end or side of the bed.

The deflector 211 functions as a cover for the hot air outlet 204 when arranged in the closed condition of use shown in FIG. 7*a*. The deflector 211 also serves as an on-off switch for the air cooler 200 because it is essential that the deflector 211 be fully open for the air cooler 200 to operate safely. The unit 200 is switched on when the cover is fully open.

The same deflector 211 protects the hot air opening 204 to inhibit dust from entering when the air conditioner 200 is not in use. Opening the hot air deflector 211 also exposes warning indicator lights that enable a user to diagnose a failure of the air-conditioner to operate because of one or more of the following reasons:

1. the temperature at the cold heat absorbing side of the air-conditioner may be low enough for ice to form, potentially causing damage;
2. temperature at the heat emitting side of the air-conditioner may be too high for safe operation; and
3. the container that optionally retains water condensed at the cold heat absorbing side of the air-conditioner may be full and unable to accept any further water.

These conditions are detected by appropriate sensors and an electronic circuit in the air-conditioner 200 ensures that the air conditioner will not operate under these conditions and that the appropriate warning indicator light is illuminated In order to minimise the inconvenience of having to empty the water container at intervals, a device on the heat emitting side 212 of the air-conditioner 200 causes small drops of condensed water to be sprayed into the air so that it is evaporated by the heat and passes out as water vapour into the room. The small increase in humidity outside the enclosed sleeping space, like the increase in temperature, is imperceptible to the people using the room. This process is described in CN 203586424U, the contents of which is incorporated herein by way of reference.

With reference to FIG. 9, the electrical system 450 of the air conditioner 200 includes:

a. a processor 452 connected to a power supply 492;
b. a series of indicators 476;
c. a series of sensors 456, 460, 464, 472, and 468;
d. a compressor 482; and
e. a fan motor 480 driving the evaporator fan 262 and the condenser fan 252.

The temperature sensor 454 mounted on the evaporator 454 senses when ice is likely to form, potentially damaging the evaporator, and operates the switch 456. A further temperature sensor 460 mounted on the discharge tube of the compressor 458 senses when the compressed gas temperature exceeds an upper permissible limit, potentially damaging the compressor, and operates the switch 460.

A float in the water retaining tank 462 operates the switch 464 when the tank is full.

A moving part 470 of the hot air cover 211 operates the switch 472 when the hot air cover 211 is in the fully open position.

A moving part 466 of the cold air deflector 208 operates the switch 468 when the cold air deflector 208 is in the fully open position.

The processor 452 monitors the signals from the switches 456, 460, 464, 472 and 468.

When the signals from switches 472 and 468 indicate that both the hot air cover and the cold air deflector are in the fully open position, the processor supplies power to the fan motor 480.

When the signals from switches 472 and 468 indicate that both the hot air cover and the cold air deflector are in the fully open position, and the signal from switch 456 indicates that the evaporator temperature is above the freezing condition, and the signal from switch 460 indicates that the compressor discharge temperature is less than the permissible upper limit, and the switch 464 indicates that the water tank is not full, then the processor supplies power to the compressor 482. The processor also ensures that the compressor is not restarted within a certain minimum time to prevent the possibility that the compressor will be started while there is excessive residual gas pressure in the refrigeration circuit. The minimum time is typically between one minute and three minutes, depending on the design of the compressor and the refrigeration circuit. It will be appreciated that, depending on the design of the compressor motor, it is possible for the processor to operate the compressor at different speeds in order to regulate the cooling power of the refrigeration circuit. It is also possible for the processor, again depending on the design of the compressor motor, to provide a gradual increase in electric power to the compressor in order to avoid the requirement for excessive electrical current when the compressor is started. This is known as a "soft start" capability. It is also possible for the processor to adjust the electric power supplied to the fan motor to adjust the speed of the fans to suit the operating condition of the air-conditioner 200.

The processor provides power to the indicator lights 476 to indicate particular operating conditions to the user such as when the evaporator temperature is below the freezing condition, when the compressor discharge temperature is above the permissible upper limit, when the water tank is full, when the electric power is available to the processor, and when the hot air cover 211 and the cold air deflector 208 are not fully open. The processor can provide a flashing on and off signal to one or more of the indicator lights to draw the attention of a user to an operating fault condition.

The earth wire from the power connection 490 is also connected to the metal casing of the compressor and other metal parts of the air conditioner 200.

The air conditioner unit includes recessed handles 224*a*, 224*b* inset into opposite side panels 226*a*, 226*b*. The handles 224*a*, 224*b* are shaped for engagement with left and right hands of a person so that the unit 200 can be picked up and carried around. The Unit 200 also includes a power outlet 228 for coupling the electric components of the unit 200 with a power cord (not shown).

Air Conditioner System 300

Figure 10A:
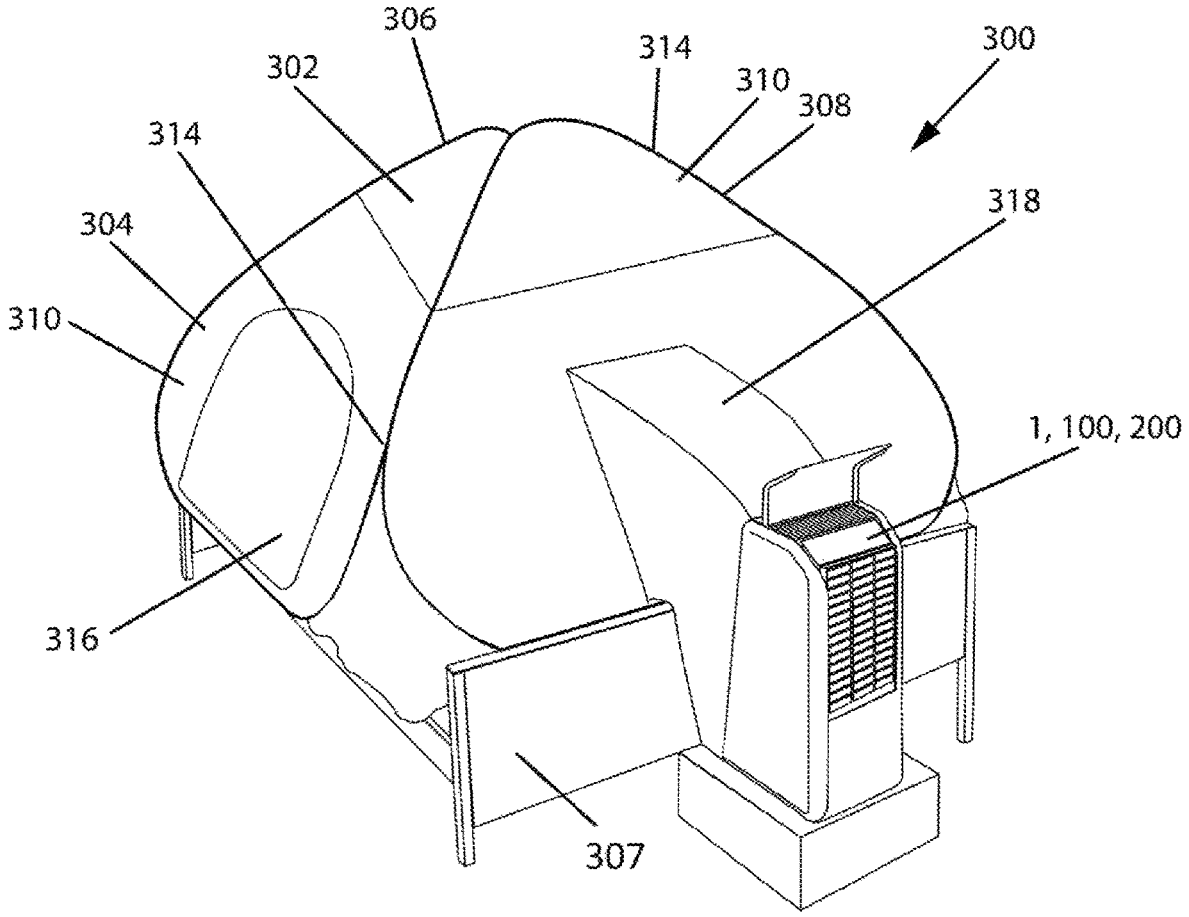
FIG. 10*a* is a front perspective view of an air conditioner system in accordance with a another preferred embodiment of the invention.
Figure 10B:
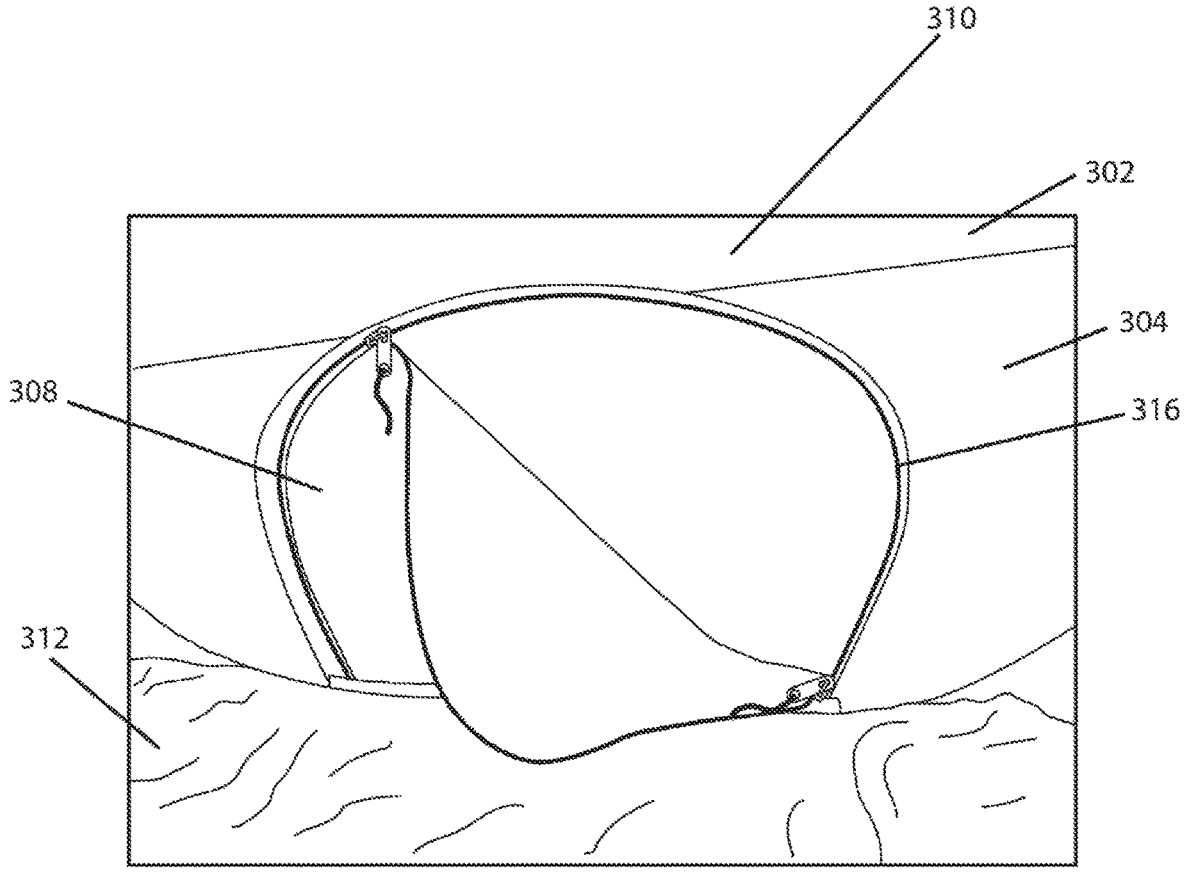
FIG. 10*b* is an internal view of an entrance of the air conditioner system shown in FIG. 10*a*.

The air conditioner system 300 shown in FIGS. 10*a* and 10*b* operates in an analogous manner to that of the above described enclosure operating with the air conditioners 1, 100, 200. However, instead of the upper and lower sections 2, 3 of the fabric enclosure being formed as part of a mosquito net enclosure 2,3 around a bed 12, for example, the upper and lower sections 302, 304 of the fabric enclosure 306 that encapsulates the sleeping area. For example, the enclosure 306 is formed as part of a tent 308 seated on a sleeping platform 307. The enclosure design of the tent 308 serves as the enclosure for the sleeping arrangement. The tent 308 is preferably an easily erected, or self-erecting tent which completely encloses the sleeping space and thereby provides a high level of insect protection.

As particularly shown in FIGS. 10*a* and 10*b*, the tent 308 includes four generally triangular panels 310 coupled to respective sides of a generally rectangular base section 312. Side sections 314 of adjacent triangular panels 310 are coupled together to create a dome like structure. The tent 308 also includes an entry aperture 316 through which a person can gain entry into, or exit from, the tent 308. Many different forms of above described tent structure are known in the art and can be interchanged with the basic structure of the tent 308. In one embodiment, the tent 308 does not include a base section 212 and encapsulates the bed 307 whilst sitting on a ground or floor surface.

The tent 308 also includes a fabric tent adapter 318 which acts as a conduit joining the air conditioner unit 1,100, 200 with the internal space of the tent 308. The adaptor 318 includes a tent connecting end section 320 coupled to a triangular panel 310 and an air conditioner connecting end section 322 coupled to the air conditioner unit 1, 100, 200. The opening at the air conditioner connecting end section 322 is smaller than the opening at the tent connecting end section 320 so that the adaptor 318 trumpets out from the air conditioner unit 1, 100, 200. This has the effect of slowing the speed of the return air entering the adapter conduit at the tent connecting end section 320 before it enters the air conditioner return air inlet 210.

Air Conditioner System 500

Figure 11A:
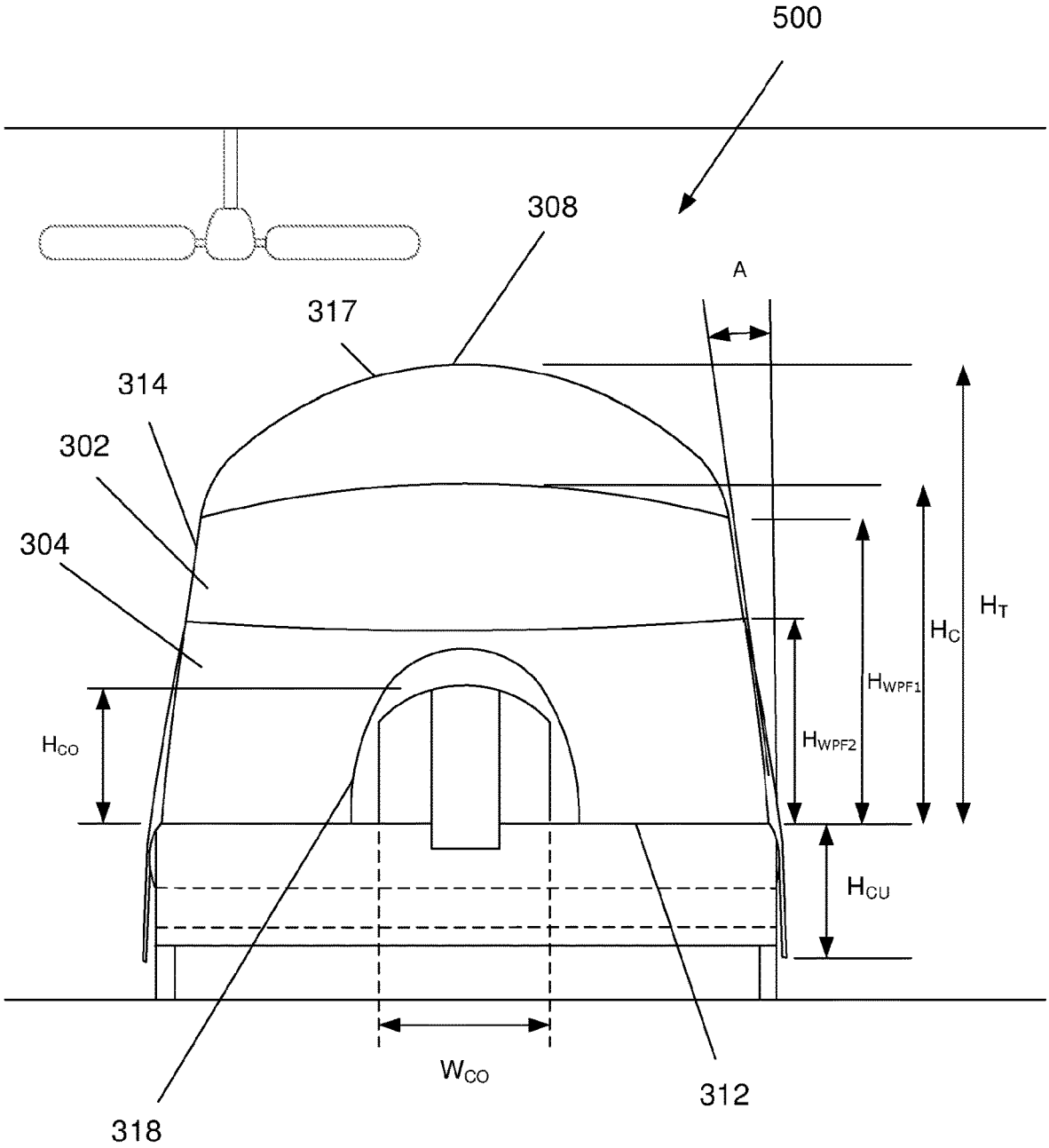
FIG. 11*a* is a front view of an air conditioner system in accordance with a preferred embodiment of the invention.
Figure 11B:
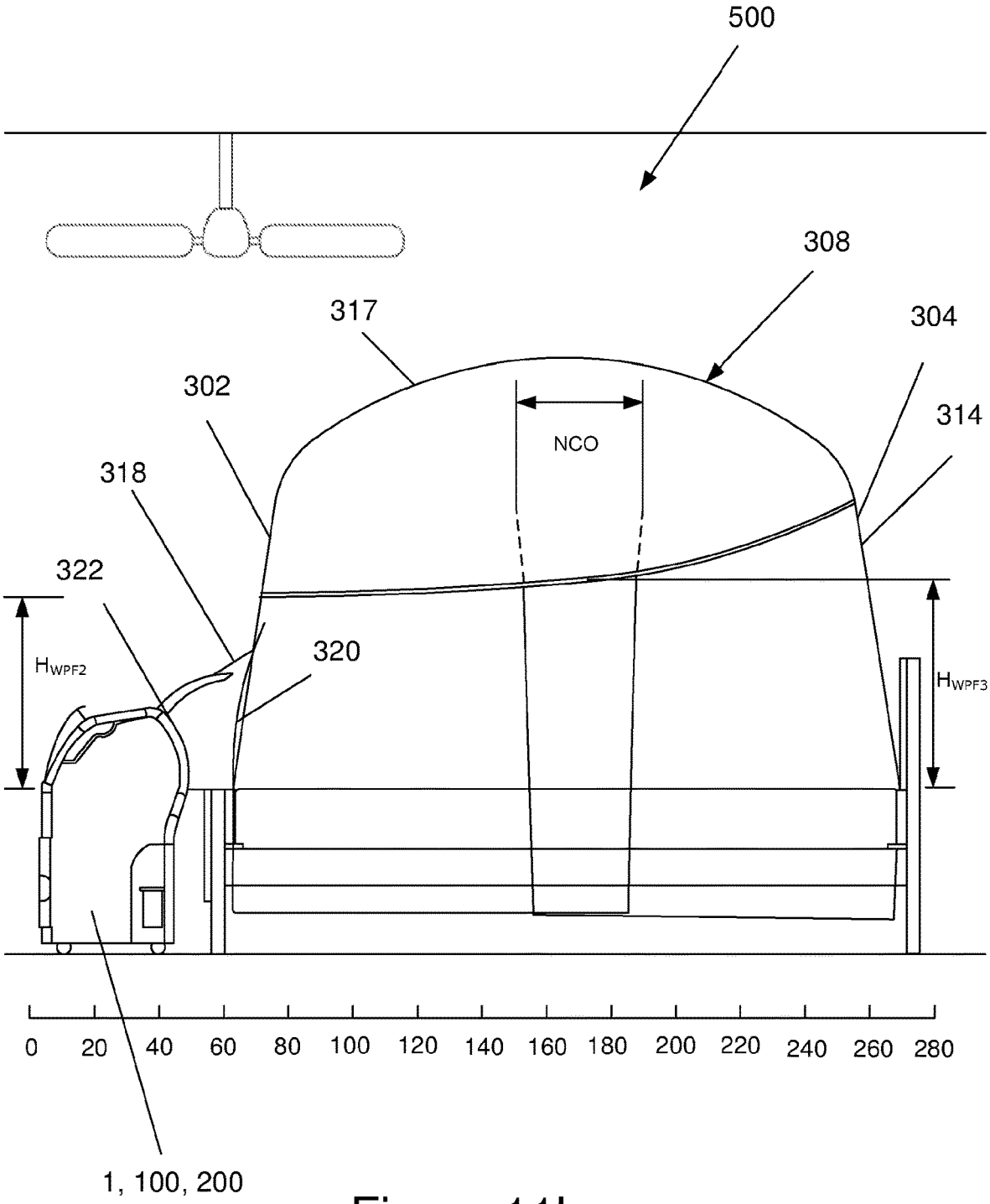
FIG. 11*b* is a right side view of the air conditioner system shown in FIG. 11*a*.

The air conditioner system 500 shown in FIGS. 11*a* and 11*b* operates in an analogous manner to that of the air conditioner system 300. Like parts are referenced with like numbers. As shown, the upper and lower sections 302, 304 of the fabric enclosure 306 are formed as part of a tent 308. Again, the enclosure design of the tent 308 serves as the enclosure for the sleeping arrangement. The tent 308 is preferably a quick, or self, erecting tent which completely encloses the sleeping space and thereby provides a high level of insect protection.

The tent 308 includes four generally triangular panels 310 coupled to respective sides of a generally rectangular base section 312. Side sections 314 of adjacent panels 310 are coupled together to create a dome like structure 317. The tent 308 also includes an entry aperture through which a person can gain entry into, or exit from, the tent 308. Many different forms of above described tent structure are known in the art and can be interchanged with the basic structure of the ten 308.

The tent 308 also includes a fabric tent adapter 318 which acts as a conduit joining the air conditioner unit 1,100, 200 with the internal space of the tent 308. The adaptor 318 includes a tent connecting end section 320 coupled to a triangular panel 310 and an air conditioner connecting end section 322 coupled to the air conditioner unit 1, 100, 200. The opening at the air conditioner connecting end section 322 is smaller than the opening at the tent connecting end section 320 so that the adaptor 318 trumpets out from the air conditioner unit 1, 100, 200. This has the effect of slowing the speed of the return air entering the adapter conduit at the tent connecting end 320 before it enters the air conditioner return air inlet 210.

The adapter 318 is substantially comprised of impervious fabric and forms the return air intake and also encloses an air projector nozzle 208 of the air conditioner unit 200. The adapter 318 also allows for the enclosure to be used on mattresses with different heights above a floor level, even though the air cooler is supported by the floor.

The adapter 318 includes an impervious divider (not shown) providing a separation between air emerging from the cold air outlet 202 and air returning to the return air intake 210 that allows air from the tent to return to the air cooler to be re-cooled. The divider piece is made of fabric and supported at either side at the tent end, and by the cold air outlet of the air cooler at the other end. The divider helps to reduce any tendency of air emerging from the cold air outlet 202 to return immediately to the return air intake 210 before circulating in the enclosure 318.

The adapter 318 is either manufactured as an extension of the enclosure, or is detachable.

The adapter 318 can be made from one or two layers of impervious fabric with an insulating layer, typically made from flexible foam material, in order to reduce the possibility of condensation in humid weather conditions The enclosure 308 preferably includes insect repellent materials incorporated into the fabric for further inhibiting ingress of insects.

The table below sets out some dimensions for the tent 308. However, these dimensions can vary to suit the needs of any particular application.

| | |
|---|---|
| $H_T$ | Top of tent max 150 cm above mattress to ensure ceiling fan does not hit tent |
| $H_{CO}$ | Cut-out extends about 50 cm above mattress |
| $H_C$ | 100 cm (+/−5 cm) above mattress in centre |
| $H_{WPF1}$ | Wind proof fabric height 90 cm (+/−5 cm) above mattress at sides at head end |
| $H_{WPF2}$ | Wind proof fabric height 60 cm (+/−5 cm) above mattress at sides at feet end |
| $H_{WPF3}$ | Wind proof fabric height 65 cm (+/−5 cm) at curtain overlap (3 to 8 cm above foot end height |
| $H_{CU}$ | Height curtains extend 40 cm (+/−2 cm) below mattress |
| $W_{CO}$ | 50 cm wide U-shaped cut-out in centre |
| A | Min slope angle for curtains 8 degrees |
| NCO | Nominal curtain overlap 50 cm minimum 35 cm at bottom |

Air Flow Through the Air Conditioner Unit 200

With reference to FIG. 8, return air from the cool air layer immediately above the sleeping platform 307 of the sleeping enclosure 300 is drawn through the flared tent end 320 of the tent adapter 318 and passes beneath the fabric divider 324 and then through the air conditioner end 322 of the adapter 318 to the return air inlet 210 of the air conditioner 200. The air is drawn through the evaporator heat exchanger 264 by the evaporator fan 262 which forces the air through the air straightener 216. The air straightener consists of a plurality of vanes 218 that cause the velocity of the air to be reduced sufficiently and the vorticity and turbulence of the air to be reduced sufficiently such that when the air passes up through the cold air outlet 202 and is redirected by the curved air deflector 208 into the sleeping enclosure 300, the cold air mixes to an appropriate extent with the layer of cooler air immediately above the sleeping platform 312. In this way, sufficient air velocity is maintained at the far end of the sleeping enclosure to provide additional perceptible cooling to the occupants, while at the same time avoiding excessive mixing with the hot air layers above the cool air layer.

The return air intake 210 has a sufficient intake area and length which maintains an air intake velocity sufficiently low to inhibit warm air above the conditioned air entering the air intake. For the air conditioner 1, included an area of pervious material serving as an air filter which maintains an air intake velocity sufficiently low to inhibit warm air above the conditioned air entering the air intake. By shaping the air intake as a duct 318 with a large enough intake area, and sufficient length, the area of the duct, decreasing towards the air cooler inlet, which has a relatively much higher intake velocity, inhibits the tendency of warm air above the cool air layer to enter the air intake. As such, there was no need for the pervious air filter.

Localised Cooling Device 1000

Figure 12:
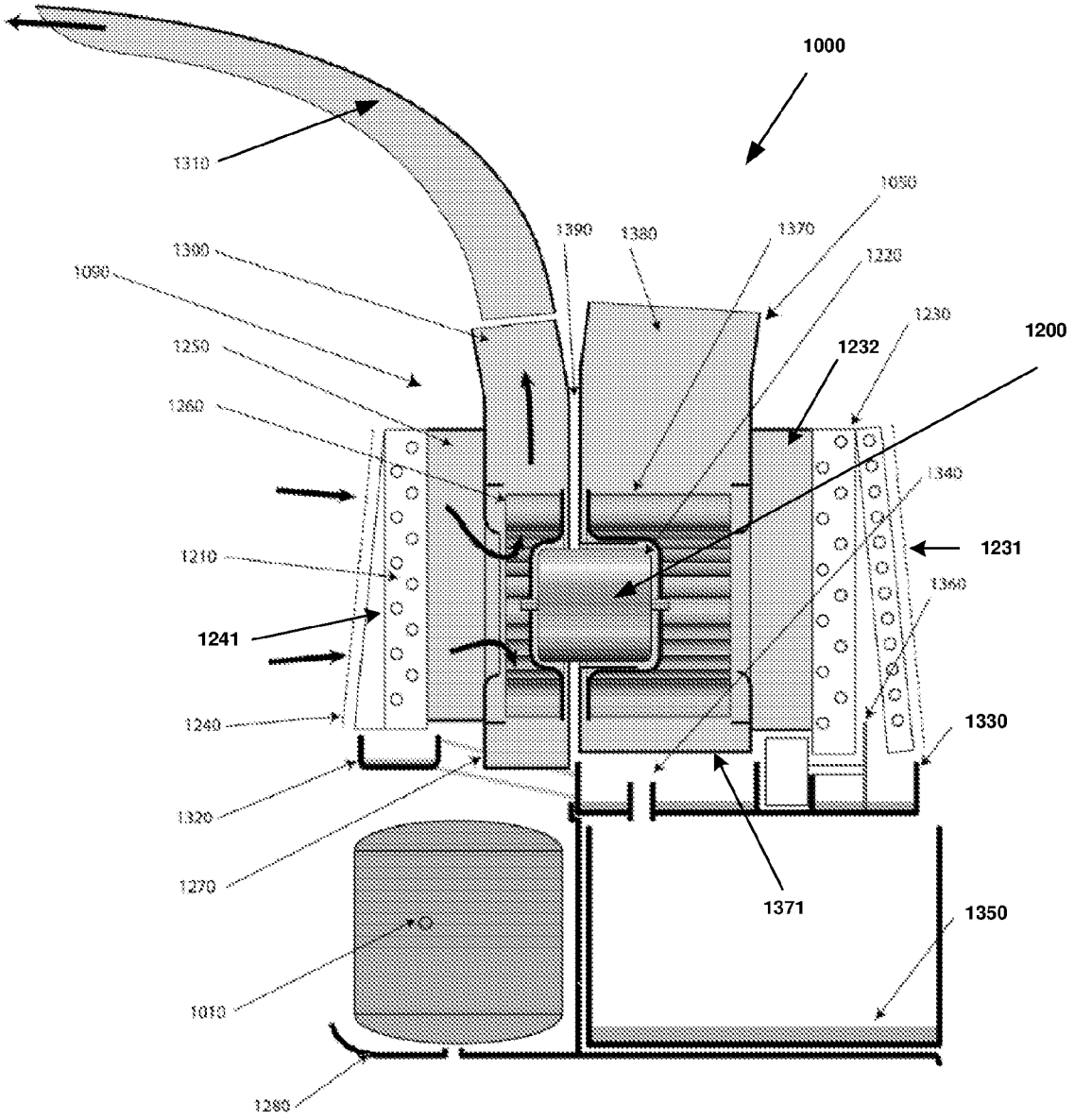
FIG. 12 is a side view of a localised cooling device with part of the housing removed.

The localised cooling device 1000 shown in FIG. 12 provides a localised cooling device that can be used independently of any one of the above described enclosures. The cooling device 100 includes an air conditioner unit 1200 including:

(a) a room air inlet;
(b) a condenser fan 1370
(c) a condenser heat exchanger 1230;
(d) a hot air outlet 1380 for directing hot air in an upward direction;
(e) a return air inlet 1241;
(f) an evaporator fan 1260;
(g) an evaporator heat exchanger 1210; and
(h) a cold air outlet 1300.

The cooling device also includes:

(a) an airflow straightener 1510 for receiving air from the cold air outlet 1300,
(b) a curved cold air deflector 1310 which acts as a conduit for directing cold air flow from the airflow straightener 1510 towards a person; and
(c) a motor 1220 for driving the evaporator fan 1260 and the condenser fan 1370

The device 1000 shown in FIG. 12 is one possible physical arrangement of the relevant components. Details of interconnecting tubing, electrical connections, and the structural components have been omitted for clarity in explaining the principles that relate to embodiments of the present invention. In this embodiment, the fan 1370 and evaporator fan 1260 are, for example, considered as centrifugal fans.

The pathway followed by air as it passes through the cold side 1090 of the air conditioner 1200 is described below in further detail. A person skilled in the art will readily appreciate that the warm air pathway on the warm side 1050 of the air-conditioner is similar in principle.

Air enters the return air inlet 1241 and passes through the return air inlet filter 1240 just before passing through the spaces between the fins of the evaporator 1210. Air leaving the evaporator enters a plenum space 1250 before being drawn into the inlet of the evaporator centrifugal fan impeller 1260 driven by an electric motor 1220. A plenum space 1250 is provided to ensure that air flows with a relatively even velocity across the full area of the evaporator heat exchanger 1210, maximising the heat exchanger efficiency. Air leaving the centrifugal fan impeller 1260 enters a volute 1270 surrounding the impeller and passes from the volute 1270 substantially vertically upwards through the cold air outlet 1300. A curved cold air deflector nozzle 1310 changes the direction of the air to a substantially horizontal direction towards the location of the person using the air-conditioner.

Air from the room is also drawn through the room air filter 1231 adjacent to the condenser 1230, passing through the passages between the condenser fins through a plenum 1232 to an inlet of the condenser centrifugal fan impeller 1370 mounted on the same motor shaft as the evaporator centrifugal fan impeller 1260 driven by the motor 1220. Air leaving the centrifugal fan impeller 1370 enters a volute 1371 and passes out in a substantially vertical direction through the warm air outlet 1380. Air is also drawn through the gap 1390 between the evaporator fan casing and the condenser fan casing in order to pass through the electric motor 1220 to the inlet of the centrifugal fan impeller 1370 to provide cooling for the motor 1220.

A particular advantage of the arrangement in which both the evaporator fan impeller 1260 and the condenser fan impeller 1370 are attached to the same shaft passing through the motor 1220 is that only one motor is required to drive both fans. This reduces the cost and provides a relatively compact physical arrangement of the components.

In order to achieve such a precisely localised cooling effect from a reasonable distance, a jet of conditioned air should leave curved cold air deflector nozzle 1310 in such a way that the cooling effect extends some distance from the origin of the jet, typically at least 1.5 to 2 metres away. It is also desirable that the direction of the nozzle 1310 be adjustable so that the direction of the air jet can be directed at the required cooling location where the person is located.

In order to achieve this, the air jet leaving the curved cold air deflector nozzle 1310 must have as little turbulence as possible: any turbulence in the jet is likely to promote mixing with the surrounding air, reducing the air velocity and reducing the cooling sensation at the location of the person.

The curved cold air deflector has at least one side piece for reducing spillage of air from an at least one side of the deflector. The deflector can be called a curved air projector. Without side pieces on the curved air projector 1310, the pressure difference caused by the acceleration of the air flow towards the centre of curvature causes the airflow near each side of the deflector to "spill" over each side of the curved air projector 1420, reducing the quantity of the air available at the end of the projector to flow in the direction of the desired air jet 1430. This spill effect may cause a considerable reduction of apparent cooling at a distance from the end of the curved air projector.

Figure 13A:
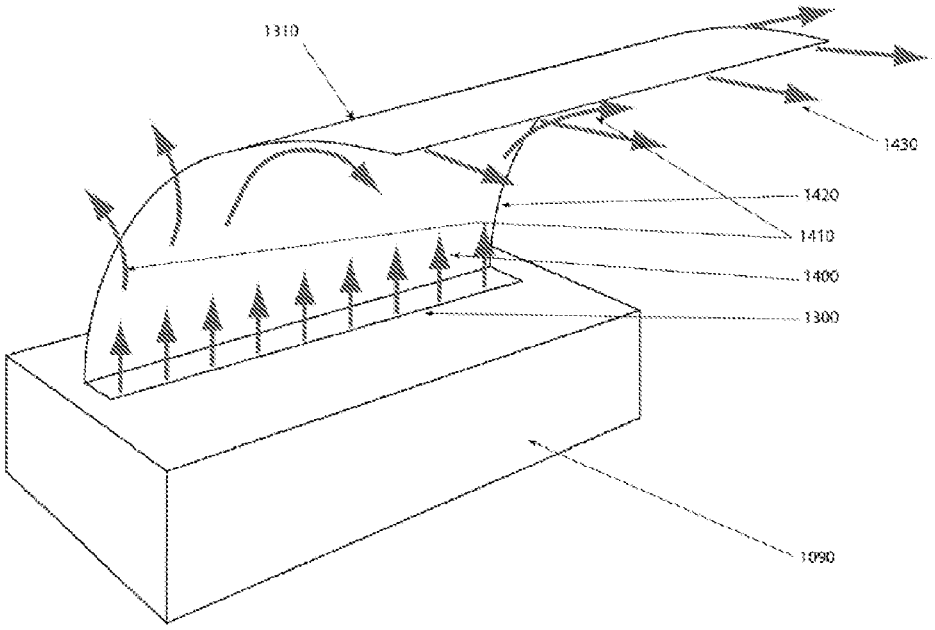
FIGS. 13*a* and 13*b* are perspective views of curved air deflector nozzles of the device shown in FIG. 12.
Figure 13B:
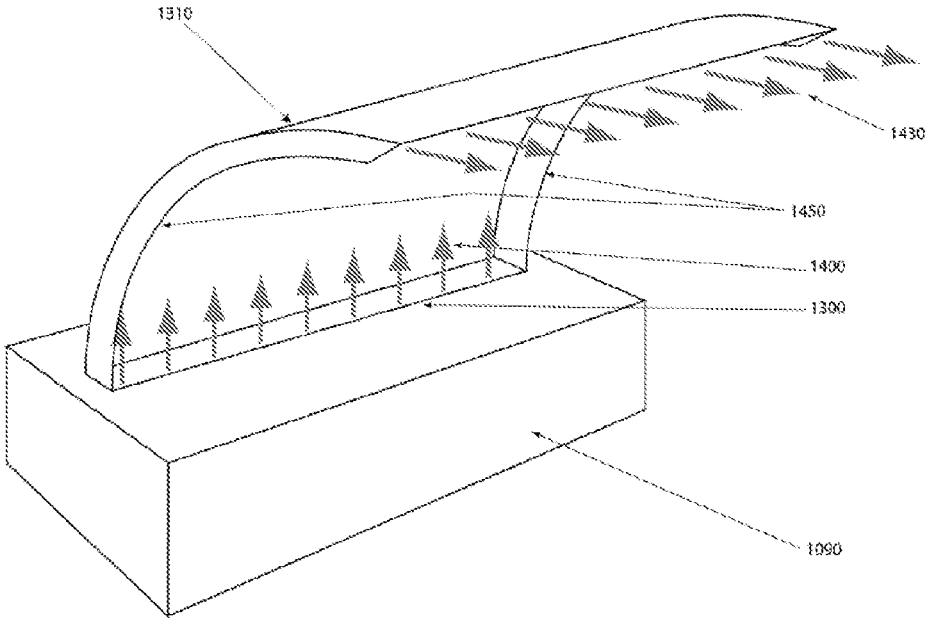

As particularly shown in FIG. 13*b*, the deflector side pieces 1450 inhibit air spillage described above and ensuring that all the air emerging from the rectangular cold air outlet 1300 reaches the end of the curved cold air deflector nozzle moving in a coherent jet substantially in a horizontal direction 1430.

The advantage of a one-sided curved air projector with side pieces is that it can be rotated to a closed position where it acts as a cover for the top and front of the air-conditioner when the air-conditioner is not in use. This prevents dust from contaminating the air inlet and air outlet when the air-conditioner is not in use. Small rotations of the curved air projector can be used to adjust the direction of the coherent jet according to the preference of the user.

A preferable alternative is to provide a compact air flow straightener located between the evaporator fan 1260 and the curved cold air deflector nozzle 1310 to eliminate undesirable vorticity from the air. A centrifugal fan tends to provide the most compact and convenient air pump for an air conditioner because the fan for the cold side of the air-conditioner can be mounted on the same shaft as the fan for the hot side of the air-conditioner, often with the motor mounted in between the two fans.

It is conventional to use forward sloping blades in a centrifugal fan to ensure that the air leaves the impeller substantially in a tangential direction aligned with the volute space surrounding the impeller. However, in this application, a small personal localised air conditioner, the air velocity at the cold air outlet nozzle should be about 3 metres per second to achieve a satisfactory jet of cold air which mixes with the surrounding air as little as possible, while still providing sufficient cooling effect at a distance of about 1.5-2 metres from the air conditioner. A centrifugal fan with forward sloping blades can cause the air to leave a suitably sized impeller at about 12-18 metres per second. The velocity of the air, therefore, needs to be greatly reduced to achieve the desired exit velocity necessitating a loss of much of the kinetic energy in the air generated by the fan impeller. This also contributes substantial noise from the fan which is undesirable in a small air conditioner. The variation of air velocity across the exit from the volute casing is large, and air can even be sucked into the exit aperture in some locations of the exit aperture.

A centrifugal fan with a backward sloping impeller, on the other hand, causes the air to leave the impeller substantially in a radial direction at much less velocity, typically 3-5 metres per second. Using this arrangement the kinetic energy loss in the flow straightener is much reduced, and also the noise of the fan is substantially less. The distribution of air velocity across the exit from the volute casing is also substantially more uniform.

Therefore it is preferable to use a backward sloping centrifugal fan impeller in this application. However, it is still necessary to straighten the air flow and remove vorticity.

In certain embodiments, the evaporator heat exchanger may perform the dual function of a heat exchanger and an airflow straightener.

Many different airflow straighteners have been described in the prior art. Typically they are comprised of a series of narrow air passages which are sufficiently small and long for the turbulent air entering each passage to become laminar at the exit. Straighteners can be made, for example, from honeycomb structures (e.g. U.S. Pat. No. 4,270,577), or a large number of rectangular or circular tubes arranged in a parallel array (e.g. U.S. Pat. No. 6,047,903A). Such airflow straighteners have commonly been used to provide a very even distribution of air velocity and at the same time eliminate vorticity typically in applications such as instrumented wind tunnels for aerodynamic experimentation. In another arrangement, a filter material is arranged in the form of an elongated folded zigzag so as to present a very large surface area to the incident flow (e.g. U.S. Pat. No. 7,905,153 B2). This also provides a high degree of flow straightening and turbulence removal. In another arrangement a large plate with an array of small holes provides similar function (e.g. U.S. Pat. No. 3,840,051).

All these airflow straighteners present manufacturing challenges and take a relatively large amount of space. They are also relatively costly parts which is undesirable for a mass-manufactured personal localised air conditioner.

An alternative air flow straightening arrangement provides a satisfactory degree of flow straightening and turbulence removal in a much more compact form. In this arrangement the air leaving the centrifugal fan impeller enters a curved volute passage surrounding the outside of the fan and passes through this passage to the airflow straightener and then to the cold air outlet nozzle.

Figure 14:
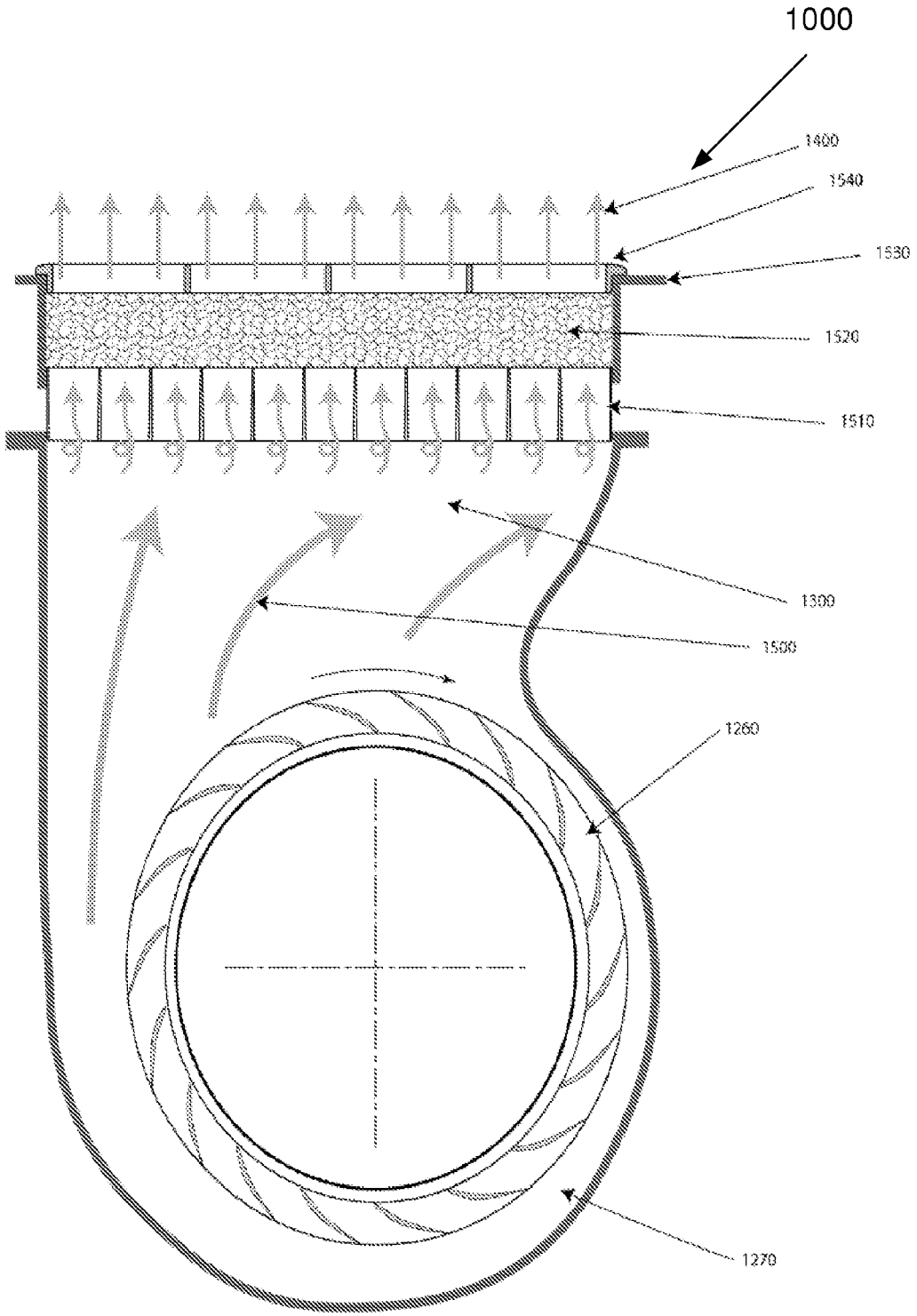
FIG. 14 is a view of an air flow straightener and an open cell foam of the device shown in FIG. 12.

FIG. 14 shows such an embodiment, where the localised cooling device further comprises a section of foam for reducing vorticity in the airflow. The air leaving the evaporator centrifugal fan impeller 1260 into the volute 1270 passes substantially upwards through the cold air outlet 1300 and then through an airflow straightener 1510 so as to align the flow in a substantially vertical direction and then through a piece of open cell foam 1520 to remove most of the vorticity. The cold air outlet grille 1540 consists of a few horizontal crossbars designed to retain the foam in place in the top of the housing 1530 so that it is not blown out by the air stream. After the air 1400 passes through the grille 1540 its flow direction is changed from a vertical direction to a substantially horizontal direction by the curved cold air deflector nozzle 1310.

The flow straightener consists of a parallel array of rectangular passages approximately 10 mm×10 mm in cross section and about 40 mm long which can be made in a single plastic injection moulded part. The passages are too large and too short to remove most of the vorticity but they are sufficient to change the direction of the air flow from the centrifugal fan 1500 to a vertical direction. Smaller passages would be difficult to manufacture using low cost injection moulding methods. The foam that eliminates the vorticity in the air flow is desirably cut from open cell plastic foam material 10-15 mm thick with a cell size of typically 3 mm -6 mm, a material which is commonly used for aquarium filters and available at very low cost.

Many modifications will be apparent to those skilled in the art without departing from the scope of the present invention The reference to any prior art in this specification is not, and should not be taken as, an acknowledgment or any form of suggestion that the prior art forms part of the common general knowledge in Australia In this specification and the claims that follow, unless stated otherwise, the word "comprise" and its variations, such as "comprises" and "comprising", imply the inclusion of a stated integer, step, or group of integers or steps, but not the exclusion of any other integer or step or group of integers or steps.

References in this specification to any prior publication, information derived from any said prior publication, or any known matter are not and should not be taken as an acknowledgement, admission or suggestion that said prior publication, or any information derived from this prior publication or known matter forms part of the common general knowledge in the field of endeavour to which the specification relates.

LIST OF PARTS

1 Air conditioner
2 Upper section of fabric enclosure
3 Lower section of fabric enclosure
5 Attachment
6 Light weight rods
7 Ceiling
9,10 Leakage
11 Floor level
12 Bed
90 Air cooler outlet
100 Air conditioner system
102 Tent
104 Upper section of fabric enclosure
106 Lower section of fabric enclosure
200 Air conditioner unit
202 Cool air outlet
204 Hot air outlet
206 Top of air conditioner unit
208 Curved air deflector
210 Inlet
211 Deflector
212 Heat emitting side of air conditioner unit
216 Air straightener
218 Vane
220 Condenser
222 Heat absorbing side of the air conditioning unit
224*a*, 224*b* Handle
226*a*, 226*b* Side of unit
228 Power connector
250 Fan motor
252 Condenser fan
254 Condenser heat exchanger
256 room air flow into the room air inlet
258 hot exhaust air from the condenser fan
262 evaporator fan
264 evaporator heat exchanger
266 return air flow towards the return air inlet
268 cold conditioned air flow into the sleeping enclosure
300 Air conditioner system
302 Upper section of the fabric enclosure
304 Lower section of the fabric enclosure
306 Fabric enclosure
307 Sleeping platform
308 Tent
310 Triangular panel
312 Base Section
314 Side sections of triangular panel
316 Entrance aperture
318 Tent adapter
320 Tent section of adapter
322 Air conditioner unit section of adaptor
324 Fabric air divider
450 Electrical control system
452 Processor
454 Evaporator temperature sensor
456 Evaporator temperature sensor switch
458 Compressor discharge tube temperature sensor
460 Compressor discharge tube sensor switch
462 Water tank float
464 Water tank float switch
466 Moving part of cold air deflector
468 Cold air deflector switch
470 Moving part of hot air cover
472 Hot air cover switch
476 Indicator lights
480 Fan motor
482 Compressor
490 Earth connection
492 Power connection
500 Air conditioner system
1000 Localised cooling device
1050 Warm side
1090 Cold air side
1210 Evaporator heat exchanger
1220 Electric motor
1230 Condenser heat exchanger
1231 Room air filter
1232 Plenum
1240 Return air inlet filter
1241 Return air inlet
1250 Plenum space
1260 Evaporator centrifugal fan impeller
1270 Volute
1300 Cold air outlet
1310 Curved cold air deflector nozzle
1370 Condenser centrifugal fan impeller
1371 Volute
1380 Warm air outlet
1390 Gap
1400 Air leaving the cold air outlet
1430 Air jet
1450 Deflector side pieces
1500 Air flow leaving centrifugal fan
1510 Airflow straightener
1520 Open cell foam
1530 Housing
1540 Cold air outlet grille Claims defining the invention:

1. A localised cooling device including:

(a) an air conditioner unit comprising a room air inlet, a condenser fan, a condenser heat exchanger, a hot air outlet for directing hot air in an upward direction, a return air inlet, an evaporator fan, an evaporator heat exchanger and a cold air outlet;

(b) an airflow straightener for receiving air from the cold air outlet;

(c) a curved cold air deflector which acts as a conduit for directing cold air flow from the airflow straightener towards a person; and (d) one or more motors for driving the evaporator fan and the condenser fan; and (e) an adapter acting as a conduit joining the air conditioner unit with a sleeping, space of a sleeping enclosure the adapter comprising:

a flared connecting end section coupled to the sleeping enclosure;

an air conditioner connecting end section coupled to the return air inlet; and a divider providing separation between air emerging from the cold air outlet and a return air intake duct that allows air from the sleeping enclosure to enter the return air inlet to be re-cooled, and the return air intake duct is larger at the sleeping enclosure than the return air inlet so air enters the air intake duct from the sleeping enclosure at a slower speed than air entering the return air inlet.

2. A localised cooling device according to claim 1, wherein the condenser fan and the evaporator fan are centrifugal fans.

3. A localised cooling device according to claim 2, wherein the evaporator fan has a backward sloping impeller.

4. A localised cooling device according to claim 1, wherein both the evaporator fan and the condenser fan are positioned on a same shaft.

5. A localised cooling device according to claim 4, wherein the motor is mounted between the evaporator fan and the condenser fan.

6. A localised cooling device according to claim 1, wherein the curved cold air deflector has at least one side piece for reducing spillage of air from an at least one side of the deflector.

7. A localised cooling device according to claim 1, further comprising a section of foam for reducing vorticity in the conditioned airflow.

8. A localised cooling device according to claim 7, wherein the foam section is an open cell plastic.

9. A localised cooling device according to claim 7, wherein the foam section is 10 to 15 mm thick.

10. A localised cooling device according to claim 7, wherein the foam section includes cells having a cell size of 3 to 6 mm.

11. A localised cooling device according to claim 7, further comprising an outlet grille for retaining the foam section.

12. A localised cooling device according to claim 11, wherein the outlet grille comprises horizontal crossbars.

13. A localised cooling device according to claim 1, wherein the airflow straightener is situated between the evaporator fan and the cold air outlet.

14. A localised cooling device according to claim 1, wherein the one or more motors include two motors for respectively driving the evaporator fan and the condenser fan.

15. A localised cooling device according to claim 14, wherein the two motors are adapted to provide separate speed control to the evaporator fan and the condenser fan.

16. A localised cooling device according to claim 1, wherein the evaporator fan passes air through the air straightener, wherein the air straightener comprises a series of vanes for reducing an exit air velocity.

17. A localised cooling device according to claim 16, wherein the air velocity is reduced to 0.4 m/s.

18. A localised cooling device according to claim 1, further including a sprayer on a heat emitting side of the unit that sprays drops of condensed water into the air for evaporation by the heat and passes out as water vapour into the room, reducing the air temperature to improve heat transfer from the condenser heat exchanger.

19. A localised cooling device according to claim 1, wherein the return air inlet has a sufficient area of pervious material serving as an air filter which maintains an air intake velocity sufficiently low to inhibit warm air above the conditioned air entering the air inlet.

20. A localised cooling device according to claim 1, wherein the return air inlet has a sufficient intake area and length which maintains an air inlet velocity sufficiently low to inhibit warm air above the air conditioned air entering the inlet.

21. A localised cooling device according to claim 1, wherein the adapter is made with one or two layers of impervious fabric with an insulating layer in order to inhibit condensation in humid weather conditions.

22. A localised cooling device according to claim 21, wherein the insulating layer is made from flexible foam material.

23. An air conditioner unit for generating a conditioned air flow for an air conditioner system including a sleeping enclosure defining a sleeping space into which conditioned air is adapted to be delivered from one end or side of the sleeping space to contact a person or persons in the sleeping space, the enclosure including an upper air pervious section and a lower relatively air impervious section adapted to surround a bed in the sleeping space and configured to inhibit passage of the conditioned air from the sleeping space through the pervious section or other leakage paths, the air conditioner unit including:

(a) a heat emitting side including:

(i) a room air inlet;

(ii) a condenser fan;

(iii) a condenser heat exchanger; and (iv) a hot air outlet located on a top side of the air conditioner unit for directing hot air in an upward direction; and (b) a heat absorbing side including:

(i) a return air inlet;

(ii) an evaporator fan;

(iii) an evaporator;

(iv) air straightener;

(v) a cold air outlet located in an upper section of the air conditioner unit; and (vi) a curved cold air deflector coupled to the cool air outlet which acts as a conduit for directing the cold air flow towards a person or into the sleeping enclosure for the sleeping application when arranged in an open condition;

(c) one or more motors for driving the evaporator fan and the condenser fan; and (d) an adapter acting as a conduit joining the air conditioner unit with the sleeping space of the sleeping enclosure, the adapter comprising:

a flared connecting end section coupled to the sleeping enclosure;

an air conditioner connecting end section coupled to the return air inlet; and a divider providing separation between air emerging from the cold air outlet and a return air intake duct that allows air from the sleeping enclosure to enter the return air inlet to be re-cooled, and the return air intake duct is larger at the sleeping enclosure than the return air inlet so air enters the air intake duct from the sleeping enclosure at a slower speed than air entering the return air inlet.

24. The unit claimed in claim 23, wherein the one or more motors includes two motors for respectively driving the evaporator fan and the condenser fan.

25. The unit claimed in claim 24, wherein the two motors are adapted to provide separate speed control to the evaporator fan and the condenser fan.

26. The unit claimed in claim 23, wherein the evaporator fan passes air through the air straightener which comprises a series of vanes designed to reduce the exit air velocity and also to ensure that the airflow is sufficiently straightened to avoid unwanted mixing between colder air just above the sleeping surface and warmer layers of air above.

27. The unit claimed in claim 26, wherein the series of vanes is designed to reduce the exit air velocity to less than 4 m/s.

28. The unit claimed in claim 23, including a sprayer on a heat emitting side of the unit that sprays drops of condensed water into the air for evaporation by the heat and passes out as water vapour into the room, reducing the air temperature to improve heat transfer from the condenser heat exchanger.

29. The air conditioner unit claimed in claim 23, wherein the deflector for the cool air outlet maintains an airflow velocity over the exposed skin of person(s) in the sleeping space, while at the same time creating a laminar airflow to reduce the tendency of the air flow coining from the deflector to mix with surrounding air.

30. The air conditioner unit claimed in claim 23, wherein the return air inlet has a sufficient area of pervious material serving as an air filter which maintains an air intake velocity sufficiently low to inhibit warm air above the conditioned air entering the air inlet.

31. The air conditioner unit claimed in claim 23, wherein the return air inlet has a sufficient intake area and length which maintains an air inlet velocity sufficiently low to inhibit warm air above the air conditioned air from entering the inlet.

32. An air conditioner system including:

(a) an air conditioner unit as claimed in claim 23;

(b) the sleeping enclosure defining the sleeping space into which conditioned air is adapted to be delivered from one end or side of the sleeping space to contact a person or persons in the sleeping space, the sleeping enclosure including:

(i) the upper air pervious section; and (ii) the lower relatively air impervious section adapted to surround a bed in the sleeping space and configured to minimize passage of the conditioned air from the sleeping space through the pervious section or other leakage paths; and wherein the impervious section extends to a height above the sleeping surface of the bed at the end or side of the bed opposed to said end or side sufficient to contain the conditioned air as it moves towards and returns from the opposite end or side of the sleeping space, and wherein the impervious, section extends to a sufficiently increased height above the sleeping surface at the opposite end or side to allow the direction of air flow to reverse towards said one end or side while inhibiting loss of conditioned air through the pervious section.

33. The system claimed in claim 32, wherein the sleeping enclosure is a tent enclosing the sleeping space and inhibiting insects such as mosquitoes from accessing the skin of the people inside the enclosure.

34. The system claimed in claim 32, wherein the sleeping enclosure is a self-supporting tent.

35. The system claimed in claim 32, further comprising insect repellent materials incorporated into the sleeping enclosure for inhibiting ingress of insects.

36. The system claimed in claim 32, wherein the opening of the air conditioner connecting end section is smaller than the opening of the tent connecting end section so that the adapter trumpets out from the air conditioner unit.

37. The system claimed in claim 32, wherein the adapter is substantially comprised of impervious fabric and forms the return air intake and also encloses an air projector nozzle of the air conditioner unit.

38. The system claimed in claim 32, wherein the adapter also allows for the enclosure to be used with mattresses with different heights above a floor level, even though the air cooler is supported by the floor.

39. The system claimed in claim 32, wherein the divider is an impervious divider.

40. The system claimed in claim 39, wherein the divider is made of fabric and supported at either side at the flared connecting end section, and by the cold air outlet of the air conditioner unit at the other end.

41. The system claimed in claim 32, wherein the adapter is either manufactured as an extension of the enclosure, or is detachable.

42. The system claimed in claim 36, wherein return air from a cool air layer immediately above the bed is drawn through the tent connecting end section of the tent adapter and through the air conditioner end section of the adapter to the return air inlet.

43. The system claimed in claim 32, wherein the air is drawn through the evaporator heat exchanger by the evaporator fan which forces the air through the straightener where the vanes cause the velocity of the air to be reduced sufficiently and the vorticity and turbulence of the air to be reduced sufficiently such that when the air passes up through the cold air outlet and is redirected by the curved air deflector into the sleeping enclosure, the cold air mixes with the layer of cooler air immediately above the bed.

44. The system claimed in claim 32, wherein sufficient air velocity is maintained at the far end of the sleeping enclosure to provide additional perceptible cooling to the occupants, while inhibiting mixing with the hot air layers above the cool air layer.

45. The system claimed in claim 32, wherein the sleeping enclosure is a self-supporting tent.

46. The system claimed in claim 32, wherein the sleeping enclosure is a dome seated on a floor or ground surface that encapsulates the bed.

* * * * *